US010590570B2

(12) United States Patent
Tone et al.

(10) Patent No.: US 10,590,570 B2
(45) Date of Patent: Mar. 17, 2020

(54) THIN WOVEN FABRIC

(71) Applicant: TOYOBO STC CO., LTD., Osaka (JP)

(72) Inventors: Hajime Tone, Osaka (JP); Hideki Kawabata, Osaka (JP)

(73) Assignee: TOYOBO STC CO., LTD., Osaka (JP)

( * ) Notice: Subject to any disclaimer, the term of this patent is extended or adjusted under 35 U.S.C. 154(b) by 53 days.

(21) Appl. No.: 15/542,233

(22) PCT Filed: Jan. 13, 2015

(86) PCT No.: PCT/JP2015/050604

§ 371 (c)(1),
(2) Date: Jul. 7, 2017

(87) PCT Pub. No.: WO2016/113833

PCT Pub. Date: Jul. 21, 2016

(65) Prior Publication Data

US 2018/0000170 A1 Jan. 4, 2018

(51) Int. Cl.
*D03D 15/00* (2006.01)
*D01D 5/253* (2006.01)
(Continued)

(52) U.S. Cl.
CPC ..... *D03D 15/0083* (2013.01); *D01D 5/253* (2013.01); *D01F 6/60* (2013.01);
(Continued)

(58) Field of Classification Search
CPC combination set(s) only.
See application file for complete search history.

(56) References Cited

U.S. PATENT DOCUMENTS

2005/0205741 A1* 9/2005 Chen ..... B60R 11/0211 248/317
2009/0136750 A1 5/2009 Shen et al.
(Continued)

FOREIGN PATENT DOCUMENTS

JP 2009-127184 6/2009
JP 2010-168675 8/2010
(Continued)

OTHER PUBLICATIONS

International Search Report dated Apr. 14, 2015 in International (PCT) Application No. PCT/JP2015/050604.

*Primary Examiner* — Arti Singh-Pandey
(74) *Attorney, Agent, or Firm* — Wenderoth, Lind & Ponack, L.L.P.

(57) ABSTRACT

A woven fabric that is advantageously used for sportswear, and has a high tear strength, maintains a low air-permeability, and has a good abrasion resistance while the fabric is lightweight and thin. The woven fabric comprises a synthetic multifilament comprising a modified monofilament having a filament transverse cross-section of a substantially quadrilateral shape, wherein: the synthetic multifilament has a total fineness 5 to 60 dtex; the modified monofilament has a single yarn fineness of 1.0 to 7.5 dtex; the woven fabric includes the synthetic multifilament in an amount of 45% or more by mass relative to 100% by mass of the woven fabric; and an average contact length where the modified monofilament touches a modified monofilament adjacent thereto is 8 to 40 μm on a cross-section in a direction perpendicular to the synthetic multifilament.

8 Claims, 11 Drawing Sheets

(51) Int. Cl.
*D01F 6/60* (2006.01)
*D03D 13/00* (2006.01)

(52) U.S. Cl.
CPC ..... *D03D 13/008* (2013.01); *D03D 15/00* (2013.01); *D10B 2331/02* (2013.01); *D10B 2331/04* (2013.01); *D10B 2501/04* (2013.01)

(56) References Cited

U.S. PATENT DOCUMENTS

| | | | | |
|---|---|---|---|---|
| 2013/0035014 | A1* | 2/2013 | Tone | D03D 13/008 442/189 |
| 2013/0312155 | A1 | 11/2013 | Tone et al. | |
| 2017/0356105 | A1* | 12/2017 | Tone | D03D 15/0083 |
| 2019/0055682 | A1* | 2/2019 | Onodera | D01D 5/253 |

FOREIGN PATENT DOCUMENTS

| | | |
|---|---|---|
| JP | 2013-245423 | 12/2013 |
| JP | 2014-101597 | 6/2014 |

* cited by examiner

[Fig.1]
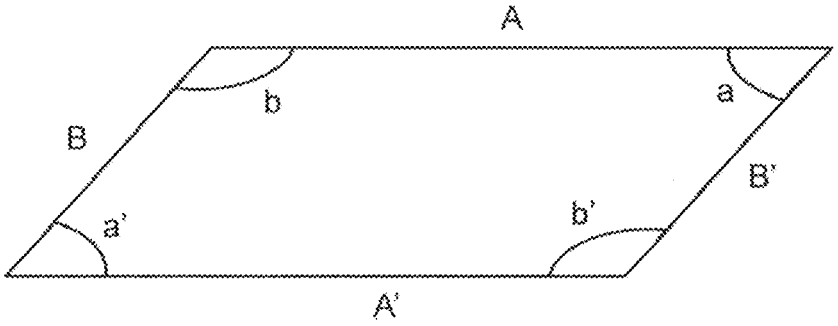
[Fig.2]
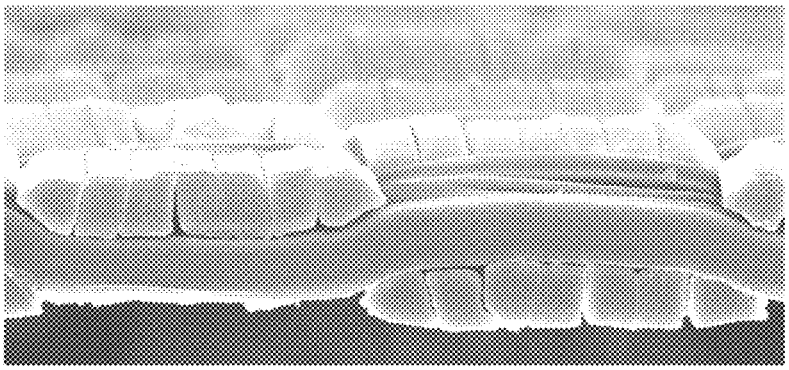
[Fig.3]
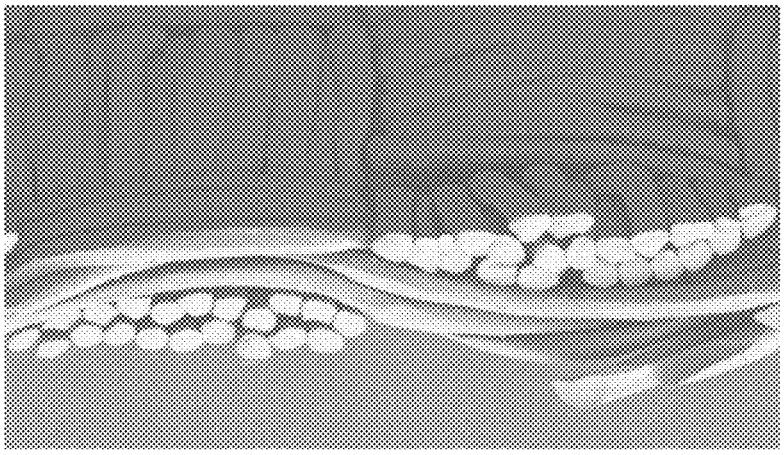

[Fig.4]
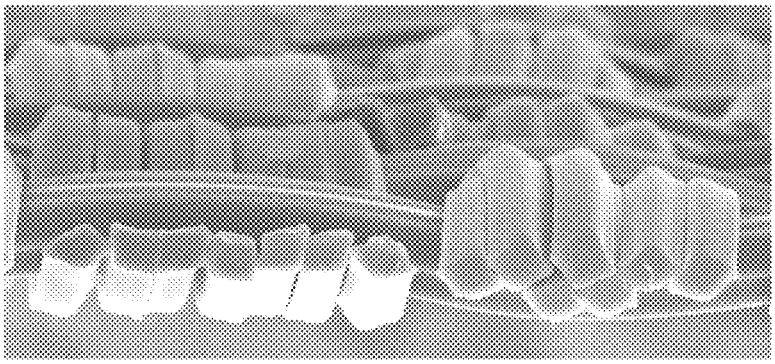
[Fig.5]
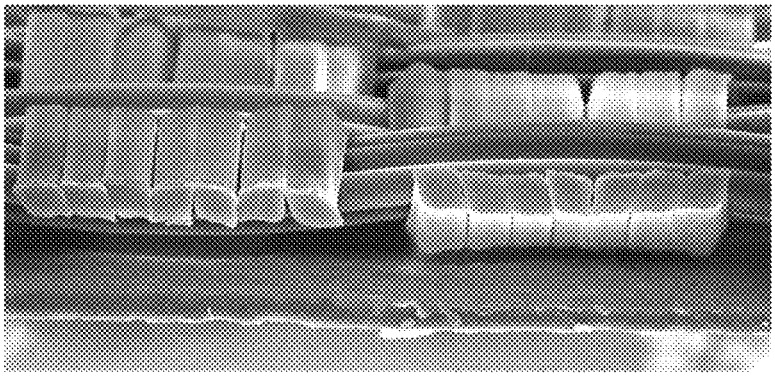

[Fig.6-1]
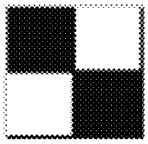
[Fig.6-2]
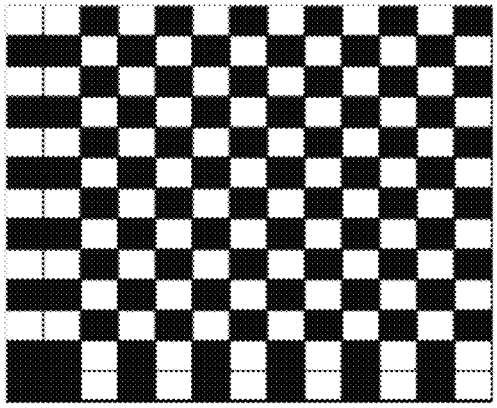
[Fig.6-3]
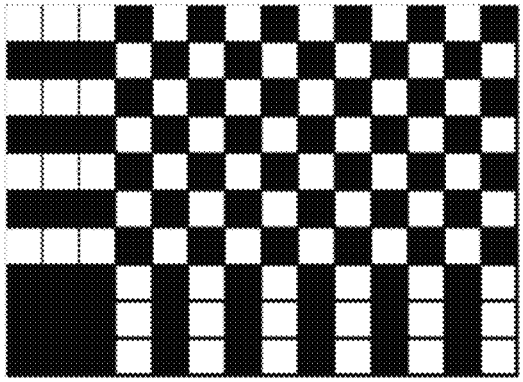
[Fig.7]
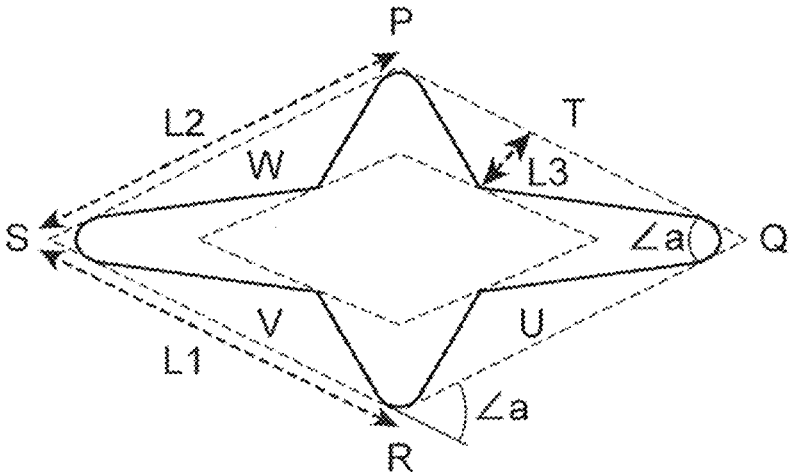

[Fig.8-1]
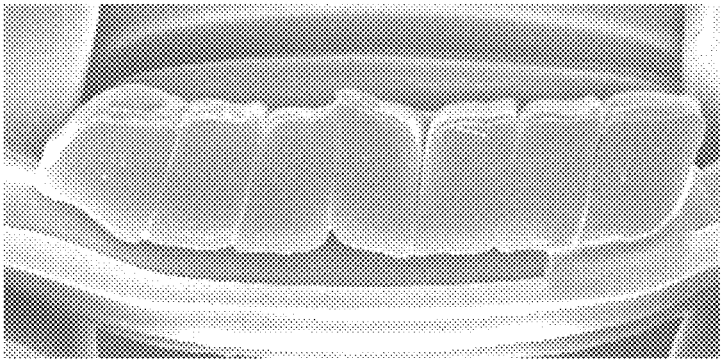
[Fig.8-2]
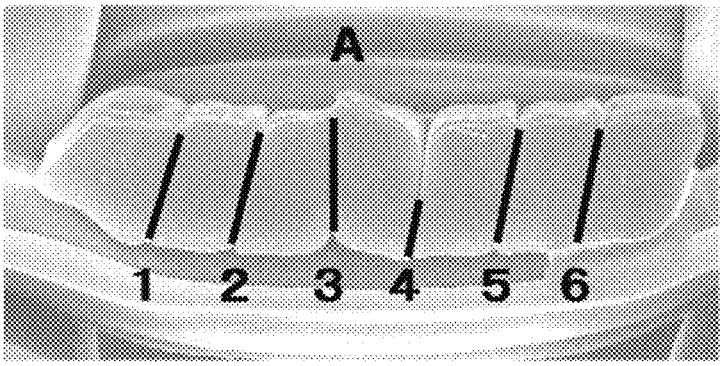

[Fig.9-1]
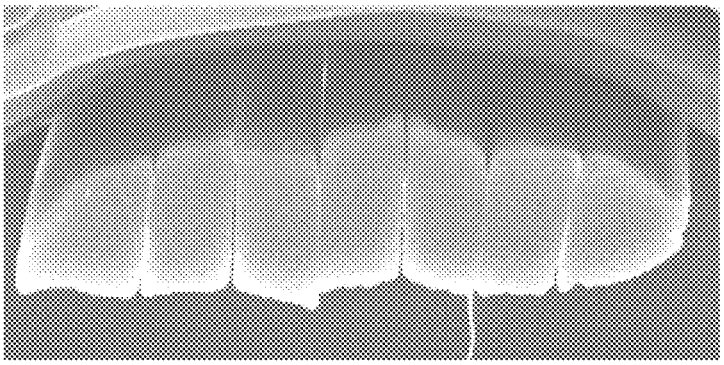
[Fig.9-2]
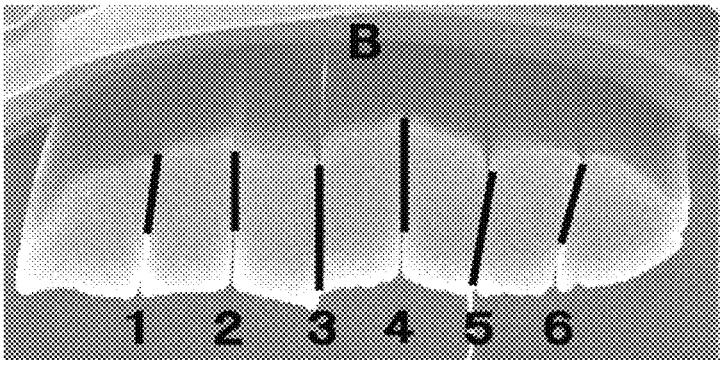
[Fig.10-1]
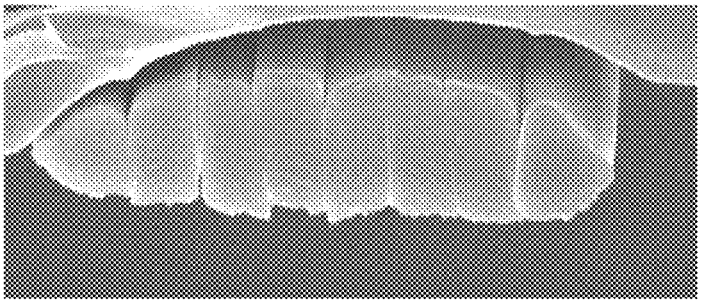
[Fig.10-2]
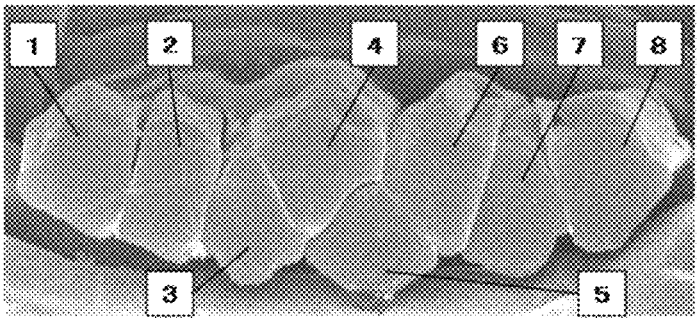

[Fig.11]
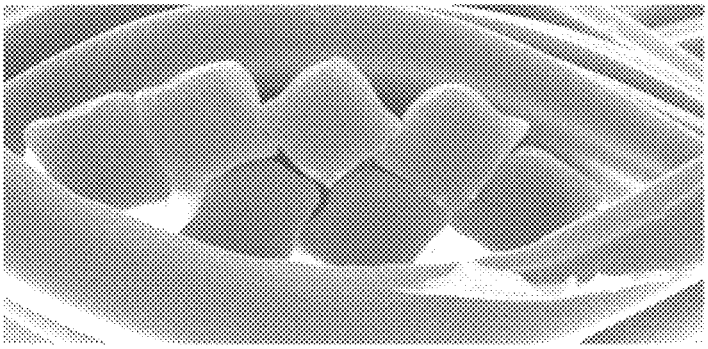
[Fig.12-1]
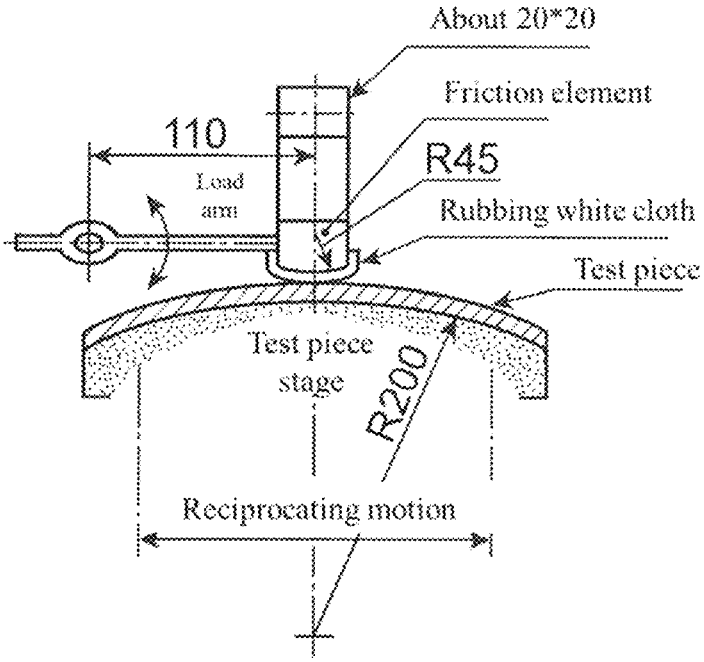

[Fig.12-2]
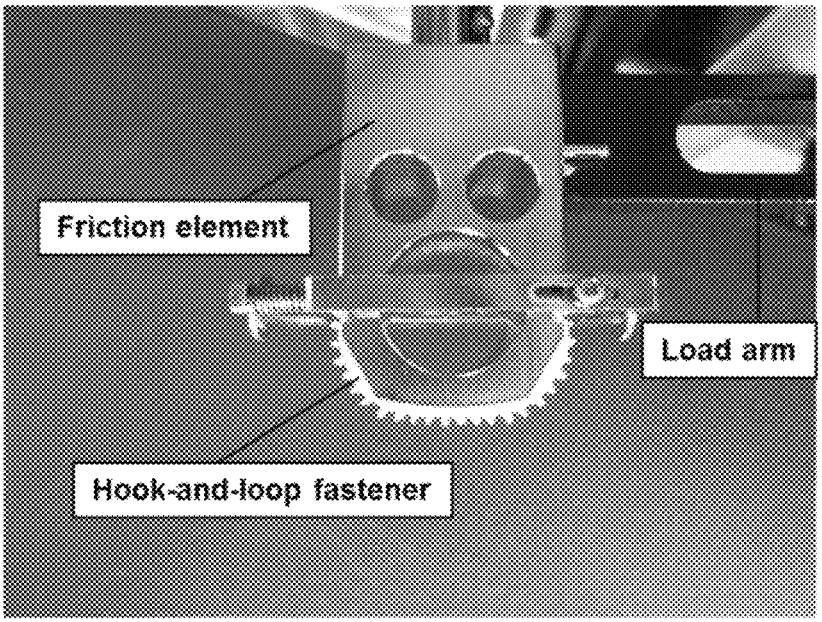
[Fig.12-3]
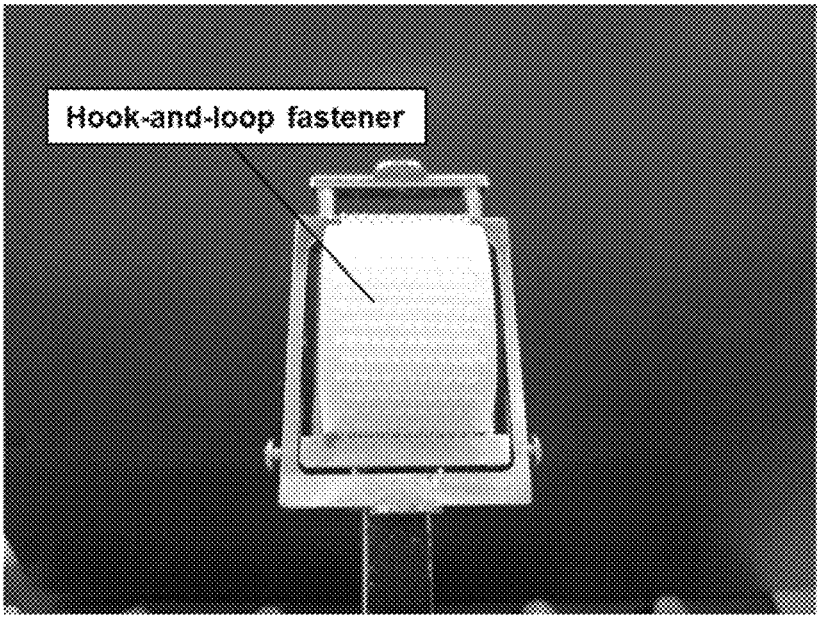

[Fig.12-4]
Shape of sample (mm)
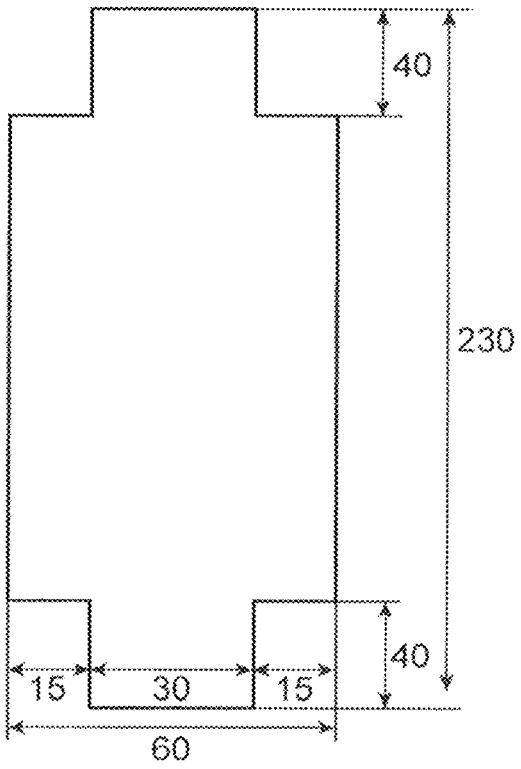

[Fig.13-1]
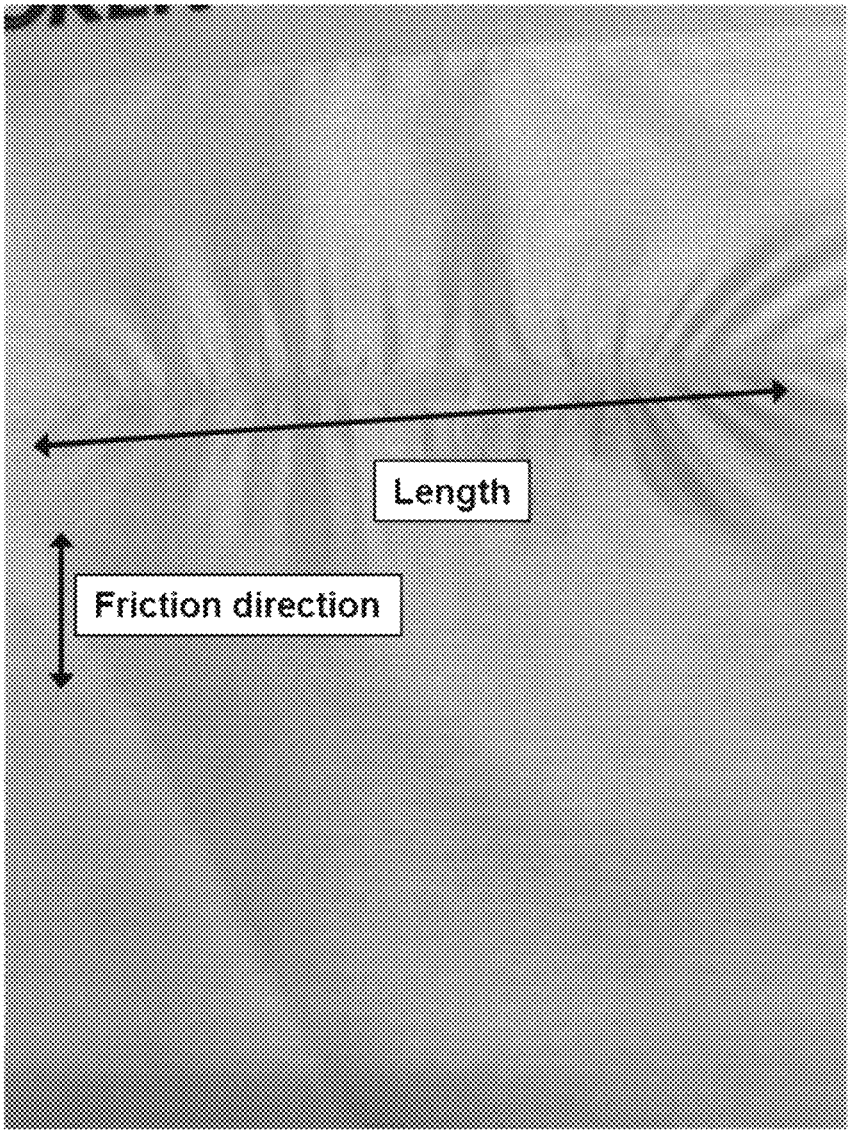

[Fig.13-2]
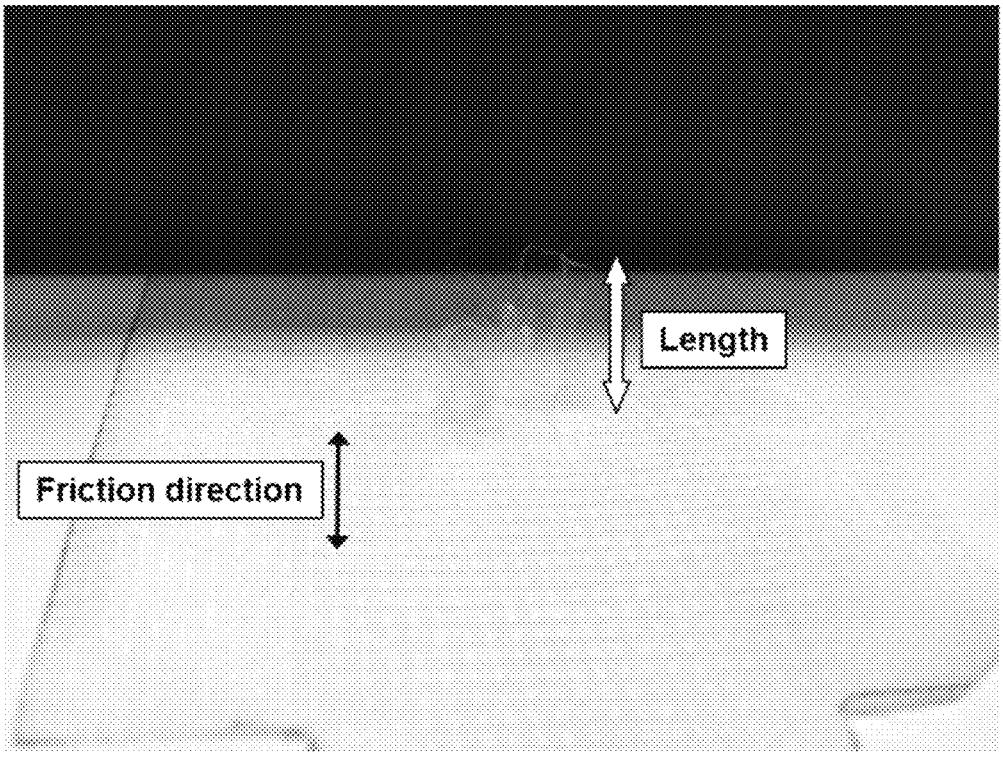

[Fig.13-3]
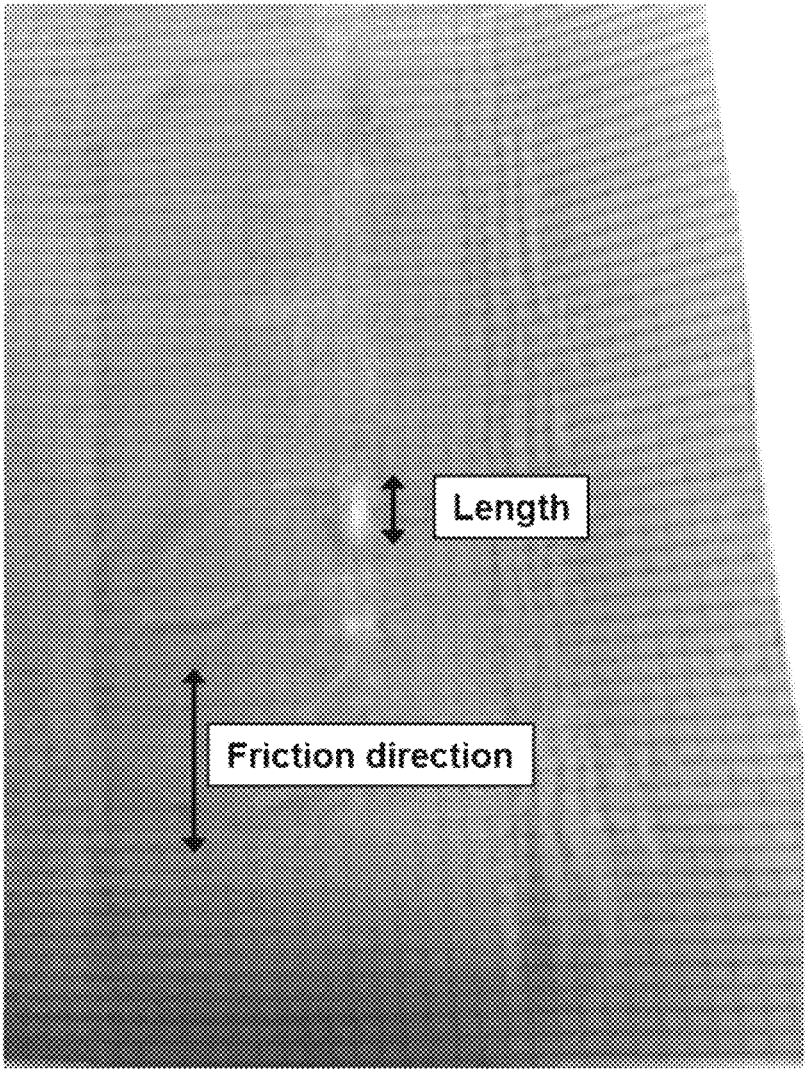

THIN WOVEN FABRIC

TECHNICAL FIELD

The present invention relates to a woven fabric used for materials of, for example, tents and sportswear such as down wear, down jackets, windbreakers, futons, sleeping bags, and rainwear. More specifically, the present invention provides a woven fabric that inhibits: fluffing on a surface of the woven fabric; leakage of down from a rubbed portion; and degradation of air permeability at the rubbed portion, even when rubbing in putting on clothing such as outdoor wear, or rubbing of a tent or a rucksack against branches and leaves or the like, occurs.

BACKGROUND ART

Clothing, in particular, outer clothing such as a windbreaker, a down jacket, down wear, and rainwear may be fluffed or torn in a side or shoulder portion by being put on or by being rubbed against a rucksack or the like in the case of, for example, the rucksack being carried on the back. Particularly, in recent years, the weight of down wear is becoming lighter and lighter. While a side cloth is a thin and lightweight fabric, a problem arises that the side cloth is rubbed against, for example, grass or trees, or a rucksack during mountain climbing or the like when used for outer clothing, and a down or feather may leak from the surface of a woven fabric due to degradation such as tear of the surface or fluffing.

Also for rainwear, a problem arises that the surface thereof is rubbed against a rucksack or the like and torn during mountain climbing, and raindrops permeate through the front fabric face. Further, a woven fabric resistant to abrasion against another object is required for rucksacks, tents, and the like used for mountain climbing, camping, and the like. Thus, for outdoor clothing and materials, a woven fabric that is thin, lightweight, and further excellent in abrasion resistance, is required.

For example, Patent Literature 1 discloses a method in which abrasion properties of a material for clothing is omnidirectionally improved by specifying a range of an intrinsic viscosity of polyester fibers of a woven fabric and setting crystallinity of the polyester fibers to be in a certain range in order to obtain an abrasion-resistant woven fabric. However, in this method, although it is certain that abrasion properties are improved, it is difficult to maintain characteristics such as down-proof properties and low air permeability required for a side cloth of down jackets, rainwear, articles for mountain climbing, and the like.

For a side cloth of ultralight down wear and rainwear to which the present invention is mainly applied, an ultrathin and lightweight woven fabric is obtained by using fine filaments. Further, the woven fabric has a high density to close gaps between filaments in order to prevent spouting of batting and entering of water. Also as a fine filament used for obtaining low air permeability, a filament which has a relatively low single yarn fineness, and includes the increased number of fibers, is used. However, in a case where fibers having a low single yarn fineness are used, the fibers are likely to be damaged due to rubbing when used and consumed. Particularly in these applications using fine filaments, a problem that is concerned directly with reduction of the strength of the woven fabric, or degradation of air permeability, arises.

CITATION LIST

Patent Literature

[PTL 1] Japanese Laid-Open Patent Publication No. 2010-168675

SUMMARY OF THE INVENTION

Problems to be Solved by the Invention

The present invention has been made in view of such a problem of a conventional art, and an object of the present invention is to provide a fabric that is advantageously used for sportswear such as down wear, a down jacket, a windbreaker, a futon, a sleeping bag, rainwear, a tent, a bag, and a rucksack, and materials thereof, and that has a high tear strength, assuredly maintains a low air-permeability, and has a good abrasion resistance while the fabric is lightweight and thin.

Solution to the Problems

The inventors of the present invention have considered that a synthetic multifilament having a high single yarn fineness and the reduced number of filaments as compared to a conventional art, is used such that the air permeability and the strength of the woven fabric are inhibited from being degraded by a monofilament being broken due to rubbing when used as described above. However, a problem arises that, if a synthetic multifilament having a high single yarn fineness and the reduced number of filaments is merely used, air permeability is degraded. Meanwhile, it is found that, in a case where a filament having a low fineness that is not greater than 25 dtex, is used, fibers in the filament are likely to be aligned in line, in the woven fabric, along the woven fabric surface direction, and, when the fibers are moved, even if the movement of the fibers is slight, air permeability is likely to be degraded. Therefore, the inventors of the present invention have found that, in a case where the cross-section of the monofilament is formed into a substantially quadrilateral shape, an arrangement of a synthetic multifilament in which a contact area in which the fibers touch each other is increased to reduce shift between the fibers, and air permeability is less likely to be degraded, can be realized, and the present invention has been completed.

That is, the woven fabric of the present invention has features described below.

(1) A woven fabric comprising: a synthetic multifilament comprising a modified monofilament having a filament transverse cross-section of a substantially quadrilateral shape, wherein; the synthetic multifilament has a total fineness of not less than 5 dtex and not greater than 60 dtex; the modified monofilament has a single yarn fineness of not less than 1.0 dtex and not greater than 7.5 dtex; the woven fabric includes the synthetic multifilament in an amount of 45% or more by mass relative to 100% by mass of the woven fabric; and an average contact length where the modified monofilament touches a modified monofilament adjacent thereto is not less than 8 μm and not greater than 40 μm on a cross-section in a direction perpendicular to the synthetic multifilament.

(2) The woven fabric according to the above 1, wherein the synthetic multifilament has an arrangement where the modified monofilaments are lined in one layer on the cross-section in the direction perpendicular to the synthetic multifilament.

(3) The woven fabric according to the above (1) or (2), wherein the substantially quadrilateral shape is a parallelogram wherein each angle in a pair of opposite angles is not less than 30° and not greater than 90°.

(4) The woven fabric according to the above (3), wherein the substantially quadrilateral shape is a parallelogram wherein each angle in a pair of opposite angles is not less than 30° and not greater than 85°.

(5) The woven fabric according to the above (3) or (4), wherein the substantially quadrilateral shape is a diamond wherein all four sides are equal in length.

(6) The woven fabric according to any one of the above (1) to (5), wherein a cover factor is not less than 1450 and not greater than 2500.

(7) The woven fabric according to any one of the above (1) to (6), wherein an initial air permeability measured by Frazier type method is not higher than 2.0 $cc/cm^2/s$.

(8) The woven fabric according to any one of the above (1) to (7), wherein an air permeability measured by Frazier type method after 200 times of abrasion is not higher than 2.5 $cc/cm^2/s$.

(9) The woven fabric according to any one of the above (1) to (8), wherein the woven fabric is used for a side cloth of any of down wear, a down jacket, a windbreaker, a futon, a sleeping bag, rainwear, a tent, a bag, and a rucksack.

(10) A method for producing a woven fabric, comprising the steps of: weaving a woven fabric that includes a synthetic multifilament in an amount of 45% or more by mass relative to 100% by mass of the woven fabric; and calendering the woven fabric obtained in the weaving; wherein; the synthetic multifilament comprises a modified monofilament having a filament transverse cross-section of a substantially quadrilateral shape; the synthetic multifilament has a total fineness of not less than 5 dtex and not greater than 60 dtex; and the modified monofilament has a single yarn fineness of not less than 1.0 dtex and not greater than 7.5 dtex.

(11) The method for producing the woven fabric according to the above (10), wherein a warp density is not less than 50 multifilaments/2.54 cm and not greater than 400 multifilaments/2.54 cm; and a weft density is not less than 50 multifilaments/2.54 cm and not greater than 400 multifilaments/2.54 cm.

Advantageous Effects of the Invention

The woven fabric of the present invention has an excellent abrasion resistance which is a characteristic that has not been achieved by a conventional art while the woven fabric is lightweight, is thin, has a low air permeability, and has a high density. Down wear, rainwear, outdoor fabric articles, and the like for which the woven fabric is used, allow rubbing of the fabrics against each other, rubbing against a rock, grass, trees, or the like, and damage due to scratching to be inhibited, allow degradation of performance to be inhibited, and have a high durability.

BRIEF DESCRIPTION OF THE DRAWINGS

FIG. 1 illustrates a filament transverse cross-section of a modified monofilament used in the present invention.

FIG. 2 shows an SEM photograph of a cross-section of a thin woven fabric according to the present invention.

FIG. 3 shows an SEM photograph of a cross-section of a thin woven fabric including conventionally used monofilaments having round cross-sections.

FIG. 4 shows an SEM photograph of a cross-section of a thin woven fabric that has not been subjected to calendering.

FIG. 5 shows an SEM photograph of a cross-section of a thin woven fabric having been subjected to lamination.

FIG. 6-1 schematically illustrates taffeta weave.

FIG. 6-2 schematically illustrates a weaving pattern of a ripstop taffeta 1.

FIG. 6-3 schematically illustrates a weaving pattern of a ripstop taffeta 2.

FIG. 7 is a schematic cross-sectional view of a spinneret discharge hole used for spinning a diamond-shaped filament.

FIG. 8-1 shows an SEM photograph of a cross-section of a thin woven fabric which is a material sample A used for measuring contact lengths.

FIG. 8-2 shows an SEM photograph of a cross-section of the thin woven fabric having contact filament lines added to the material sample A.

FIG. 9-1 shows an SEM photograph of a cross-section of a thin woven fabric which is a material sample B used for measuring contact lengths.

FIG. 9-2 shows an SEM photograph of a cross-section of the thin woven fabric having contact filament lines added to the material sample B.

FIG. 10-1 shows an SEM photograph of modified monofilaments aligned in line in a woven fabric.

FIG. 10-2 shows an SEM photograph of modified monofilaments aligned in line in a woven fabric.

FIG. 11 shows an SEM photograph of disadvantageous lining of modified monofilaments.

FIG. 12-1 is a schematic diagram illustrating a testing machine of rubbing fastness testing machine type II (Gakushin-type).

FIG. 12-2 shows a photograph of a side surface of a hook-and-loop fastener fixed to a friction element.

FIG. 12-3 shows a photograph of an upper surface of the hook-and-loop fastener fixed to the friction element.

FIG. 12-4 illustrates a test piece used in an abrasion test.

FIG. 13-1 shows a photograph of a typical example of a pulling.

FIG. 13-2 shows a photograph of a typical example of fluffing.

FIG. 13-3 shows a photograph of a typical example of a hole.

DESCRIPTION OF EMBODIMENTS

Firstly, a thin woven fabric, which is lightweight, according to the present invention, will be specifically described. The thin woven fabric of the present invention is a lightweight thin woven fabric having an extremely reduced thickness since the thin woven fabric is obtained by fine fibers being woven so as to have a high density for finishing the fabric so as to be thin. In a case where reduction of a thickness is pursued at a high level for a thin woven fabric, a synthetic multifilament of the thin woven fabric is preferably formed such that monofilaments of one synthetic multifilament are aligned in line in the woven fabric (see, for example, FIG. 2, FIG. 5, FIG. 8-1, FIG. 9-1, FIG. 10-1, FIG. 10-2, and the like). In this case, warps and wefts are arranged such that only two monofilaments overlap each other at a point at which the warp and the weft intersect each other. Thus, an extremely thin woven fabric can be obtained. However, in such a thin woven fabric, air is likely to escape through a gap between the monofilaments adjacent to each other, and it is difficult to obtain a woven fabric having a low air permeability. Further, since overlapping of the monofilaments is few, such a thin woven fabric is susceptible to external stimulus such as rubbing and scratching when used, thereby causing strength or outer appearance as well as air permeability to be degraded.

In the present invention, a contact area in which the monofilament touches a monofilament adjacent thereto is increased, and, therefore, gaps in the thin woven fabric are less likely to be formed, whereby, in the thin woven fabric, an air permeability is made low, and strength and outer appearance are improved. Thus, the thin woven fabric of the present invention can become highly resistant to rubbing and scratching.

<Synthetic Multifilament•Modified Monofilament>

In order to increase a contact area in which the monofilament touches a monofilament adjacent thereto, a synthetic multifilament that includes a modified monofilament having a filament transverse cross-section having a substantially quadrilateral shape is used for the thin woven fabric of the present invention. The "substantially quadrilateral shape" represents a polygon having four sides. The substantially quadrilateral shape (including a parallelogram, a diamond, and a rectangle described below) is ideally a shape in which four vertexes are clear and four sides are straight lines. However, the substantially quadrilateral shape may not always have clear vertexes or a part of the sides of the substantially quadrilateral shape may be curved due to, for example, variation of an extruding speed, a discharge rate, or a cooling speed for a resin, in a step of producing the modified monofilament. However, the substantially quadrilateral shape of the present invention may include such a substantially quadrilateral shape (that is, a substantially quadrilateral shape having non-clear vertexes, a substantially quadrilateral shape in which a part of sides is curved) having such a problem in production.

As the substantially quadrilateral shape, for example, a parallelogram having two pairs of opposite sides such that the opposite sides of each pair are parallel to each other, is preferably used. When the opposite sides of each of the two pairs are parallel to each other, the modified monofilament easily comes into contact with the modified monofilament adjacent thereto, and the modified monofilaments used for warps and the modified monofilaments used for wefts easily overlap each other in the thickness direction of the woven fabric, whereby shift among the modified monofilaments can be reduced at a high level. The parallelogram has characteristics that, for example, opposite angles in each of two pairs of opposite angles are equal to each other, and the lengths of the opposite sides in each of the two pairs of the opposite sides are equal to each other. The parallelogram of the present invention includes, for example, a diamond in which all four sides are equal in length, a rectangle having four interior angles all of which are equal to each other, and a square having four sides all of which are equal in length, and having four interior angles all of which are equal to each other.

In the present invention, the parallelogram advantageously has a pair of opposite angles of preferably not less than 30°, more preferably not less than 35°, and even more preferably not less than 40°. When the pair of opposite angles are each less than 30°, the modified monofilaments become straight-line-shaped, and the modified monofilament is less likely to touch the modified monofilament adjacent thereto, and it is difficult to maintain a low air permeability, which is disadvantageous. The parallelogram advantageously has the pair of opposite angles of preferably not greater than 90°, more preferably not greater than 85°, and even more preferably not greater than 80°. In a case where the parallelogram (for example, a square or a rectangle) has the pair of opposite angles which are about 90°, when the modified monofilaments are lined, the modified monofilament may sometimes rotate about the center axis in the length direction, and the sides of the modified monofilaments adjacent to each other may not accurately overlap each other. Therefore, the pair of opposite angles is more preferably not greater than 85°. In a case where the opposite angles are not greater than 85°, the sides of the modified monofilaments adjacent to each other accurately overlap each other, and the modified monofilaments are advantageously likely to be evenly lined.

Further, in the present invention, in particular, it is advantageous that the parallelogram is more preferably a diamond in which all four sides are equal in length. For example, in the case of a parallelogram or a rectangle in which difference between the length of sides in one of two pairs and the length of sides in the other of the two pairs is great (flatness is excessively high), when the modified monofilaments touch each other at the sides having different lengths, the monofilaments are likely to be misaligned, and some of the modified monofilaments may not be accurately aligned in line. However, when the four sides have uniform length, the modified monofilaments are more likely to be aligned in line.

The length of the side of the substantially quadrilateral shape is, for example, preferably not less than 7 μm, more preferably not less than 9 μm, even more preferably not less than 12 μm, and particularly preferably not less than 15 μm. The length thereof is preferably not greater than 40 μm, more preferably not greater than 35 μm, even more preferably not greater than 30 μm, and particularly preferably not greater than 25 μm. When the length of the side is excessively short, the modified monofilament tends to become fine, and a failure that, for example, the filament is easily broken, may occur. Meanwhile, when the side is excessively long, the modified monofilaments are less likely to be aligned in line, and the fabric may become thick.

Further, in the substantially quadrilateral shape, when the length of the opposite sides in one of the two pairs and the length of the opposite sides in the other of the two pairs are made different from each other, a ratio (short side/long side) of the short side to the long side is preferably 0.3/1 to 0.9/1 and more preferably 0.4/1 to 0.8/1.

In the thin woven fabric of the present invention, on the cross section in the direction perpendicular to the synthetic multifilament, the modified monofilament needs to touch the modified monofilament adjacent thereto. The average contact length (hereinafter, may be referred to as "contact length") over which the modified monofilament touches the modified monofilament adjacent thereto is, for example, preferably not less than 8 μm, more preferably not less than 10 μm, and even more preferably not less than 12 μm. The average contact length is preferably not greater than 40 μm, more preferably not greater than 38 μm, and even more preferably not greater than 35 μm. When the average contact length is less than the lower limit value, the contact length of the modified monofilaments is short, whereby the air permeability of the woven fabric may be disadvantageously degraded. Meanwhile, when the average contact length is greater than the upper limit value, although the thin woven fabric tends to assuredly have a low air permeability, the fabric becomes thick and may not be compact, which are disadvantageous.

The contact length is measured by the following method. The method will be described with reference to the drawings. FIG. 8-1 shows an SEM photograph, of a cross section of one synthetic multifilament that includes seven modified monofilaments and has a total fineness of 22 dtex, in the direction perpendicular to the synthetic multifilament. On this cross-section, in the modified monofilaments, the modified monofilaments touch the modified monofilament adjacent thereto at six portions. When the contact length is measured, all the contact portions are observed. In FIG. 8-2, the contact portions in FIG. 8-1 are numbered, and contact filament lines are added to portions, respectively, at which the modified monofilaments touch the modified monofilament adjacent thereto. When the contact length is measured, all the lengths of the contact portions of the modified monofilaments of one synthetic multifilament are measured (in the case of FIG. 8-2, newly added contact filament lines), and the sum of all the lengths is divided by the number of the contact portions (in the case of FIG. 8-2, "6"), to obtain average of lengths of the contact portions of the modified monofilaments, and the obtained average of the lengths of the contact portions of the modified monofilaments is used as the contact length. FIG. 9-1 also shows an SEM photograph of a cross-section, of one synthetic multifilament that includes seven modified monofilaments, in the direction perpendicular to the synthetic multifilament. In FIG. 9-2, also on the cross-section in FIG. 9-1, similarly to the case in FIG. 8-2, the numbers and the contact filament lines are added to the portions at which the modified monofilaments touch the modified monofilament adjacent thereto. FIG. 9-2 indicates that, in the modified monofilaments, the modified monofilaments touch the modified monofilament adjacent thereto at six portions. As an example of the measurement of the contact lengths, the result of the contact lengths in the synthetic multifilament and the average thereof obtained in each of FIG. 8-2 and FIG. 9-2, is indicated in a following table. In the one synthetic multifilament shown in FIG. 8-2, the contact length is 15.1 μm. In the one synthetic multifilament shown in FIG. 9-2, the contact length is 10.3 μm In the present invention, in the similar manner, the contact lengths of any 10 warps and any 10 wefts, that is, the contact lengths of 20 synthetic multifilaments in total, are obtained, and the average thereof is used as the "average contact length".

TABLE 1

| FIG. 8-2 | | FIG. 9-2 | |
|---|---|---|---|
| Measured portion | Contact length (μm) | Measured portion | Contact length (μm) |
| A-1 | 16.7 | B-1 | 8.3 |
| A-2 | 16.7 | B-2 | 4.3 |
| A-3 | 18.0 | B-3 | 15.0 |
| A-4 | 6.7 | B-4 | 8.3 |
| A-5 | 16.0 | B-5 | 14.0 |
| A-6 | 16.7 | B-6 | 11.7 |
| Average | 15.1 | Average | 10.3 |

In the thin woven fabric of the present invention, in all the measured portions at which total 20 synthetic multifilaments, of any warps and wefts, used for measuring the contact lengths, are measured, the percentage of the measured portions at which the contact lengths are 8 to 40 μm, relative to all the measured portions corresponding to 100%, is preferably not less than 30%, more preferably not less than 40%, even more preferably not less than 50%, and particularly preferably not less than 60%. The upper limit thereof is not limited, and is preferably 100%, and may not be greater than 90%. When the percentage thereof is not less than 30%, contact areas in which the modified monofilaments touch the modified monofilament adjacent thereto, are sufficient, and the thin woven fabric having a low air permeability is likely to be obtained.

Preferably, the modified monofilament is relatively thick such that an air permeability and woven fabric strength are prevented from being degraded when the modified monofilament is broken due to rubbing or scratching during use. In this viewpoint, the modified monofilament has a single yarn fineness of, for example, not less than 1.0 dtex, more preferably not less than 1.5 dtex, and even more preferably not less than 2 dtex. Meanwhile, when the modified monofilament is excessively thick, the thin woven fabric may become hard, or it may be difficult to obtain a fabric having a high density. Therefore, the modified monofilament has a single yarn fineness of not greater than 7.5 dtex in general, preferably not greater than 6 dtex, and even more preferably not greater than 5.5 dtex.

The synthetic multifilament including the modified monofilaments has a total fineness of not less than 5 dtex, more preferably not less than 10 dtex, and even more preferably not less than 13 dtex. The synthetic multifilament including the modified monofilaments has a total fineness of not greater than 60 dtex in general, more preferably not greater than 35 dtex, and even more preferably not greater than 30 dtex. When the total fineness of the synthetic multifilament is adjusted so as to be within the above range, a woven fabric that is lightweight, is thin, and has a required strength can be obtained. Meanwhile, when the fineness of the synthetic multifilament is less than the lower limit value, a required strength may not be obtained. When the fineness is greater than the upper limit value, the woven fabric becomes bulky, and the woven fabric is less likely to become lightweight and thin.

The number of the monofilaments included in one synthetic multifilament is, for example, preferably not less than 2, more preferably not less than 3, and even more preferably not less than 5. The number of the monofilaments included in one synthetic multifilament is preferably not greater than 30, more preferably not greater than 20, and even more preferably not greater than 15. When the number of the monofilaments is increased, the monofilaments each have a reduced single yarn fineness, and the filament is likely to be broken, which is disadvantageous.

The fiber of the synthetic multifilament of the present invention is preferably a synthetic fiber made of resin. The resin is not particularly limited. For example, polyesters such as polyethylene terephthalate and polybutylene terephthalate, polyamides such as nylon 6, nylon 66, nylon 46, nylon 12, nylon 610, nylon 612, and copolymers thereof, synthetic polymers such as polyacrylonitrile, polyvinyl chloride, and polyvinyl alcohol, and the like are used. Among polyesters, polyethylene terephthalate is preferably used. Among polyamides, nylon 6 and nylon 66 are preferably used. Particularly, among them, polyamides are preferable for providing the thin woven fabric with soft feeling and also with high tear strength, also when used for modified monofilaments having substantially quadrilateral cross-sections.

When the resin is, for example, nylon, the resin of the synthetic multifilament has a relative viscosity of preferably not less than 2.0, more preferably not less than 2.5, and even more preferably not less than 3.0. The upper limit of the relative viscosity is not particularly limited. The resin of the synthetic multifilament typically has a relative viscosity of not greater than 4.5. When the resin has a relative viscosity of not less than 2.0, the obtained modified monofilament advantageously has an appropriate breaking strength. Further, when the resin has a relative viscosity of not less than 2.5, the obtained modified monofilament is allowed to have appropriate breaking strength and breaking elongation. Further, in a case where the resin has a relative viscosity of not less than 3.0, when the modified monofilament has a filament transverse cross-section having the substantially quadrilateral shape, four angles can be clearly formed. Meanwhile, when the resin has a relative viscosity of less than 2.0, since the breaking strength is low in the case of the modified cross-section as compared to a round cross-section, a problem may arise that a product has reduced tear strength or breaking strength due to insufficient breaking strength, or durability of the product is deteriorated or processing operability is deteriorated due to insufficient breaking elongation.

In a case where polyester is used as the resin of the synthetic multifilament, the resin has an intrinsic viscosity of, for example, preferably not less than 0.5, more preferably not less than 0.55, and even more preferably not less than 0.58 in the case of polyester. The upper limit of the intrinsic viscosity is not particularly limited. The resin typically has an intrinsic viscosity of not greater than 1.5. When the resin has an intrinsic viscosity of not less than 0.5, the obtained modified monofilament advantageously has an appropriate breaking strength. Meanwhile, when the resin has an intrinsic viscosity of less than 0.5, since the breaking strength is low in the case of the modified cross-section as compared to a round cross-section, a problem may arise that a product has reduced tear strength or breaking strength due to insufficient breaking strength, or durability of the product is deteriorated or processing operability is deteriorated due to insufficient breaking elongation.

A hygroscopic material, an antioxidant, a delustering agent, an ultraviolet absorbent, an antibacterial agent, and the like may be added, alone or in combination, to the modified monofilaments as appropriate. Further, a boiled water shrinkage ratio, a thermal stress, a birefringence, and an unevenness of thickness of the modified monofilament are not particularly limited, and may be set as appropriate.

A breaking strength of the synthetic multifilament is not particularly limited. The synthetic multifilament has a breaking strength of preferably not lower than 3.3 cN/dt and more preferably not lower than 4.0 cN/dt. When the synthetic multifilament has a strength of not lower than 3.3 cN/dt, a woven fabric having an appropriate tear strength can be obtained even when the modification degree is high. The upper limit of the breaking strength of the synthetic multifilament is not particularly limited, and is typically not higher than 10 cN/dt.

A breaking elongation of the synthetic multifilament is not particularly limited. The synthetic multifilament has a breaking elongation of preferably not lower than 30%, more preferably not lower than 35%, and even more preferably not lower than 40%. The synthetic multifilament has a breaking elongation of preferably not higher than 55%, more preferably not higher than 50%, and even more preferably not higher than 45%.

A content of the modified monofilaments is preferably not less than 45% by mass, more preferably not less than 55% by mass, even more preferably not less than 75% by mass, and particularly preferably not less than 85% by mass per 100% by mass of the thin woven fabric. The upper limit of the content of the modified monofilaments is not particularly limited, and is preferably 100% by mass, and may not be greater than 95% by mass per 100% by mass of the thin woven fabric. When the content ratio of the synthetic multifilament including the modified monofilaments is not less than 45% by mass, the thin woven fabric which is resistant to rubbing and scratching, and has a low air permeability, can be obtained.

The synthetic multifilament may include filaments other than the above-described modified monofilaments. In the present invention, the greater the content of the modified monofilaments in one synthetic multifilament is, the more preferable the result is. A content of the modified monofilaments in one synthetic multifilament is, for example, preferably not less than 50% by mass, more preferably not less than 60% by mass, even more preferably not less than 70% by mass, particularly preferably not less than 85% by mass, more particularly preferably not less than 95% by mass, and most preferably 100% by mass.

The synthetic multifilament used in the present invention will be specifically described.

The synthetic multifilament of the present invention may be a filament yarn, a crimped yarn such as a false-twisted yarn, or a mixture of two or more kinds of synthetic multifilaments. A synthetic multifilament formed from a filament yarn of only monofilaments of which the cross-sections are the same in shape, is preferably used. An air-entangled yarn or a twisted yarn can be used. However, it is preferable that such yarns are reduced as much as possible or minimized for improving productivity. In a case where air-entangling is used, a degree of entanglement according to JIS L1013 8.15 (hook method) is preferably about 1 to 35.

<Method for Producing Modified Monofilament>

For the synthetic multifilament used in the present invention, in order to form each modified monofilament into a substantially quadrilateral shape (in particular, diamond), a spinneret discharge hole of a nozzle is preferably designed so as to be star-shaped as shown in FIG. 7. That is, the star-shaped spinneret discharge hole that allows a modified monofilament having a substantially quadrilateral shape to be formed, has four convex portions (for example, P to S in FIG. 7) and four concave portions (for example, T to W in FIG. 7), and opposite angles, at the convex portions, of each of the two pairs are preferably equal to each other, and diagonal lines by the convex portions are preferably orthogonal to each other. When material resin is spun through the star-shaped spinneret discharge hole, the melted resin is expanded so as to spread in the four concave portions. As a result, a modified monofilament that has a filament transverse cross-section having a substantially quadrilateral shape obtained by connecting the four convex portions, is obtained. That is, the length of the side of the substantially quadrilateral shape is substantially equal to a distance between vertexes of the two convex portions adjacent to each other (in FIG. 7, the lengths L1 and L2 of the sides of the substantially quadrilateral shape are substantially equal to a distance between vertexes R-S of the convex portions and a distance between vertexes S-P of the convex portions, respectively). Therefore, an angle formed by the three convex portions of the discharge hole being connected, is adjusted, whereby interior angles of the substantially quadrilateral shape can be designed (that is, in the substantially quadrilateral shape, the interior angle at Q is almost equal to an angle formed by three vertexes P, Q, and R of the convex portions being connected).

Further, at the star-shaped spinneret discharge hole, the tips of the four convex portions are preferably rounded without forming acute angles at the tips. By the tips being rounded, the vertexes of the substantially quadrilateral shape are not distorted and the vertexes are likely to be clearly formed.

Further, in order to satisfy the condition for obtaining a parallelogram as the substantially quadrilateral shape, all the concave portion depths (L3 in FIG. 7) of the four concave portions are preferably made equal to each other. The concave portion depth is, for example, preferably 0.02 mm to 0.14 mm, and more preferably 0.04 mm to 0.12 mm. In a case where the depth is less than 0.02 mm, when a filament is spun, polymer may be expanded outward and a parallelogram may not be clearly formed. Meanwhile, when the depth is greater than 0.14 mm, even if spun polymer is expanded, the expansion is insufficient and a star-shaped filament transverse cross-section may be formed.

Further, when the spun polymer is cooled, the hole of the nozzle is preferably positioned so as to apply cooling air to each of the convex portions of P, Q, R, and S in FIG. 7. Contrarily, the hole of the nozzle is preferably positioned so as not to apply cooling air directly to the concave portions of T, U, V, and W in FIG. 7. Portions to which cooling air is positively applied and portions to which cooling air is not applied, are provided in the convex portions and the concave portions, whereby a well-balanced parallelogram is likely to be formed. In particular, in order to satisfy a condition for obtaining a diamond as the substantially quadrilateral shape, the lengths of the four sides need to be further made equal to each other while the above-described condition is satisfied. Therefore, as the viscosity of polymer, the intrinsic viscosity is preferably set to be not less than 0.5 in the case of polyester, and the relative viscosity is preferably set to be not less than 2.5 in the case of polyamide. By the viscosity being adjusted, a diamond-shaped cross-section having all four sides which are equal in length is likely to be formed.

A method for producing the synthetic multifilament having the above-described cross-section is not particularly limited. For example, a polyamide-based synthetic multifilament and a polyester-based synthetic multifilament can be produced by use of a spin-draw continuous machine in a spin-draw mode, or through two steps using a spinning machine and a drawing machine. In the spin-draw mode, the speed of the spun yarn take-up godet roller is set to be preferably 1500 m/minute to 4000 m/minute, and more preferably 2000 m/minute to 3000 m/minute.

<Thin Woven Fabric>

Hereinafter, the woven fabric of the present invention will be specifically described. In order to obtain a thin woven fabric resistant to rubbing and scratching, the thin woven fabric of the present invention includes the synthetic multifilament having a modified monofilament in an amount of 45% or more by mass, more preferably 55% or more by mass, and even more preferably 75% or more by mass relative to 100% by mass of the thin woven fabric. The upper limit of the amount is not particularly limited, and is preferably 100% by mass, and may not be greater than 95% by mass relative to 100% by mass of the thin woven fabric. When the percentage of the content of the synthetic multifilament including the modified monofilaments is not less than 45% by mass, a thin woven fabric having a low air permeability can be obtained.

In a case where reduction of a thickness is pursued at a high level for the thin woven fabric of the present invention, the synthetic multifilaments of the thin woven fabric are preferably included in the woven fabric in a state where the modified monofilaments contained in one synthetic multifilament are aligned in line (see, for example, FIG. 2, FIG. 5, FIG. 8-1, FIG. 9-1, FIG. 10-1, FIG. 10-2, and the like). When the modified monofilaments are thus aligned in line, the fabric becomes extremely thin. Further, in the present invention, in the modified monofilaments, the modified monofilament touches the modified monofilament adjacent thereto at an interface therebetween. Therefore, a thin woven fabric in which gaps between the modified monofilaments are reduced, and air permeability is low, is likely to be obtained. Meanwhile, FIG. 11 shows an example of a thin woven fabric in which the contact length is short. In the SEM photograph showing a cross-section in FIG. 11, the modified monofilaments are not evenly lined, and the contact lengths are short, whereby gaps between the modified monofilaments are increased and the thin woven fabric disadvantageously has a high air permeability.

In the thin woven fabric of the present invention, the modified monofilaments in one synthetic multifilament are preferably lined in one layer and/or two layers on the cross section in the direction perpendicular to the synthetic multifilament. This is a characteristic specific to the thin woven fabric, according to the present invention, in which the number of the included monofilaments is small, and further fine'synthetic multifilaments are used. As shown in FIG. 2, in a case where the modified monofilament which has a filament transverse cross-section having the substantially quadrilateral shape is used, even when the monofilaments are lined in one layer, a contact area in which the modified monofilament touches the modified monofilament adjacent thereto is increased and air is less likely to permeate therethrough.

FIG. 3 shows a cross-section of a conventional thin woven fabric that includes monofilaments having round cross-sections, and indicates that the monofilaments are fine and are likely to be damaged, and a contact area in which the filaments contact with each other is small even when calendering is performed, and it is difficult to maintain a low air permeability.

In the present invention, as shown in FIG. 2 and the like, an idealistic arrangement of lining in one layer is, for example, an arrangement in which the upper surface of each modified monofilament of one synthetic multifilament is exposed on the surface of the thin woven fabric, and the lower surface of each modified monofilament touches a synthetic multifilament intersecting the one synthetic multifilament.

However, the modified monofilament is sometimes arranged such that the corners (vertexes) of the substantially quadrilateral shape are oriented upward and downward. Examples of an arrangement in which the corners (vertexes) are oriented upward and downward include a state where the upper surface of the modified monofilament is exposed on the surface of the thin woven fabric and the lower surface of the modified monofilament touches another modified monofilament in the same synthetic multifilament that includes the above modified monofilament, like the fourth modified monofilament from the left in FIG. 10-2.

However, in the present invention, in a case where a modified monofilament having the corners (vertexes) oriented upward and downward is included, and modified monofilaments on both sides thereof touch the modified monofilament having the corners (vertexes) oriented upward and downward, when the contact lengths are short, this arrangement is regarded as an arrangement of lining in one layer in the present invention. A case where the contact lengths of the modified monofilaments are short represents, for example, a state where the fourth modified monofilament from the left in FIG. 10-2 and the sixth modified monofilament from the left in FIG. 10-2, touch each other. In the present invention, the contact length based on which an arrangement is determined as the arrangement of lining in one layer, is up to half the length of the short side of the substantially quadrilateral shape.

The thin woven fabric of the present invention has a cover factor (CF) of, for example, preferably not less than 1300, more preferably not less than 1450, even more preferably not less than 1500, and particularly preferably not less than 1600. The upper limit of the cover factor is not particularly limited. For example, the thin woven fabric of the present invention has a cover factor of preferably not greater than 2500, more preferably not greater than 2000, and even more preferably not greater than 1900. When the cover factor of the thin woven fabric is adjusted so as to be within the above range, a woven fabric that is lightweight, is thin, and has a low air permeability can be obtained. Meanwhile, the cover factor of the thin woven fabric is below the above range, it is difficult to satisfy the requirements for low air permeability even if calendering is performed a plurality of times although a thin and lightweight woven fabric can be obtained. Meanwhile, when the cover factor exceeds the upper limit value, although the requirements for low air permeability can be satisfied, the weight of the thin woven fabric is disadvantageously increased. The cover factor (CF) of the woven fabric is calculated by the following equation.

$$CF=T\times(DT)^{1/2}+W\times(DW)^{1/2}$$

[Where T and W represent a warp density and a weft density (multifilaments/2.54 cm) of the woven fabric, and DT and DW represent the thicknesses (dtex) of the warp and the weft of the woven fabric.]

<Method for Producing Thin Woven Fabric>

A method for producing the thin woven fabric of the present invention includes the steps of: weaving a thin woven fabric that includes a synthetic multifilament in an amount of 45% or more by mass relative to 100% by mass of the thin woven fabric, the synthetic multifilament having a total fineness of not less than 5 dtex and not greater than 60 dtex, the synthetic multifilament including a modified monofilament having a filament traverse cross-section of a substantially quadrilateral shape and having a single yarn fineness of not less than 1.0 dtex and not greater than 7.5 dtex; and calendering the thin woven fabric obtained in the weaving.

FIG. 4 shows an SEM photograph of a cross-section of a thin woven fabric which has not been calendered. In a case where the calendering is not performed, the structure is such that modified monofilaments are unevenly lined, and a lot of gaps are included. Such a thin woven fabric has an extremely high air permeability and has insufficient abrasion resistance.

In the calendering, calendering on at least one surface of the woven fabric is preferable, and calendering on both surfaces of the woven fabric is more preferable. By the woven fabric being calendered, the modified monofilaments of the woven fabric are likely to be deformed, and the modified monofilaments adjacent to each other are likely to touch each other. The modified monofilaments closely touch each other and gaps between the modified monofilaments are reduced (the contact lengths are increased) as compared to a case in which the calendering has not been performed. The number of times the calendering is performed, is not particularly limited, and may be only one or plural.

A weaving pattern for the thin woven fabric is not particularly limited. The weaving pattern may be any weave such as plain weave, twill weave, or satin weave. Among them, plain weave is preferably used since plain weave allows reduction of air permeability. In order to enhance the tear strength of the thin woven fabric, for example, the ripstop taffeta as shown in FIG. 6-2 and FIG. 6-3 is particularly preferably used.

Further, a weaving machine used to produce the woven fabric is not particularly limited, and may be selected from a water jet loom, an air jet loom, and a rapier loom. Particularly, a water jet loom and an air jet loom are preferably used.

For producing the woven fabric, a low tension sizing machine is preferably used. Further, a heald used for the loom is preferably made of a ceramic material in order to reduce friction against yarns. The substantially quadrilateral shape, a parallelogram, and a diamond that can provide a contact area greater than that of a round cross-section tend to cause fluffing. When a ceramic material is used, weaving can be performed with low friction as described above, and fluffing tends to be reduced.

The thin woven fabric has a warp density of, for example, preferably not less than 50 multifilaments/2.54 cm, more preferably not less than 80 multifilaments/2.54 cm, and even more preferably not less than 100 multifilaments/2.54 cm. The thin woven fabric has a warp density of preferably not greater than 400 multifilaments/2.54 cm, more preferably not greater than 350 multifilaments/2.54 cm, and even more preferably not greater than 250 multifilaments/2.54 cm. By the warp density being arranged so as to be within the above range, the modified monofilaments are advantageously likely to be arranged in one line and/or two lines.

Further, the thin woven fabric has a weft density of, for example, preferably not less than 50 multifilaments/2.54 cm, more preferably not less than 80 multifilaments/2.54 cm, and even more preferably not less than 100 multifilaments/2.54 cm. The thin woven fabric has a weft density of preferably not greater than 400 multifilaments/2.54 cm, more preferably not greater than 350 multifilaments/2.54 cm, and even more preferably not greater than 250 multifilaments/2.54 cm. A gray woven fabric density and a finish density may be the same or different from each other.

The woven fabric obtained in the weaving may be subjected to refining, relaxing, pre-setting, dyeing, and finishing, with use of a general processing machine for a thin woven fabric.

Further, the thin woven fabric of the present invention may be subjected to various functional processing such as water repellent treatment, coating, and laminating as appropriate. In order to adjust the feeling or strength of the woven fabric, softening treatment, resin treatment, and silicone treatment may be performed. In the softening treatment, for example, as a softener, amino-modified silicone, or a polyethylene, polyester, or paraffin softener, may be used. Further, in the resin treatment, for example, as a resin treatment agent, a variety of resins such as melamine resin, glyoxal resin, urethane resin, acrylic resin, and polyester resin may be used.

In the thin woven fabric of the present invention, a weight per unit area is, for example, preferably not less than 15 $g/m^2$, more preferably not less than 20 $g/m^2$, and even more preferably not less than 25 $g/m^2$, and a weight per unit area is preferably not greater than 70 $g/m^2$, more preferably not greater than 60 $g/m^2$, and even more preferably not greater than 55 $g/m^2$. When the weight per unit area for the woven fabric is adjusted so as to be within the above range, a woven fabric that is a thin woven fabric and has a low air permeability can be obtained. Meanwhile, when the weight per unit area for the woven fabric is less than 15 $g/m^2$, although the fabric can be finished so as to be thin and lightweight, the woven fabric having a low air permeability cannot be obtained. When the weight per unit area for the woven fabric exceeds 70 g/m$^2$, although a low air permeability can be obtained, a fabric becomes thick and a lightweight woven fabric cannot be obtained.

The tear strength, measured by a pendulum method, of the thin woven fabric of the present invention is not particularly limited. The thin woven fabric has a tear strength of preferably not lower than 6 N, more preferably not lower than 8 N, and even more preferably not lower than 10 N, in each of the warp direction and the weft direction. The thin woven fabric has a tear strength of preferably not higher than 50 N, more preferably not higher than 40 N, and even more preferably not higher than 30 N, in each of the warp direction and the weft direction. When the tear strength of the woven fabric is within the above range, a woven fabric that is lightweight, is thin, and has a required tear strength can be obtained. Meanwhile, when the tear strength is lower than 6 N, the tear strength of the woven fabric may become insufficient depending on usage. When the tear strength thereof exceeds 50 N, the fineness needs to be increased. According thereto, the fabric disadvantageously tends to be thick and hard.

The thin woven fabric of the present invention has an initial air permeability, measured by Frazier type method, of, for example, preferably not higher than 2.0 cc/cm$^2$/s, more preferably not higher than 1.5 cc/cm$^2$/s, and even more preferably not higher than 1.2 cc/cm$^2$/s. When the initial value is not higher than 2.0 cc/cm$^2$/s, a woven fabric excellent in down-proof properties can be obtained. The lower limit of the initial air permeability is not particularly limited, and is, for example, not lower than 0.05 cc/cm$^2$/s, and typically not lower than 0.1 cc/cm$^2$/s.

In the thin woven fabric of the present invention, since a contact area in which the modified monofilament touches the modified monofilament adjacent thereto is great, the filaments are fixed closely to each other, and shift between filaments during washing can be particularly reduced. The thin woven fabric of the present invention has an air permeability, after 10-times washing, of, for example, preferably not higher than 2.0 cc/cm$^2$/s, more preferably not higher than 1.5 cc/cm$^2$/s, and even more preferably not higher than 1.2 cc/cm$^2$/s. Further, the thin woven fabric of the present invention has an air permeability, after 20-times washing, of, for example, preferably not higher than 3.0 cc/cm$^2$/s, more preferably not higher than 2.5 cc/cm$^2$/s, and even more preferably not higher than 2.0 cc/cm$^2$/s. The lower limit of the air permeability after 10-times washing and the lower limit of the air permeability after 20-times washing are not particularly limited, and are, for example, not lower than 0.05 cc/cm$^2$/s, and typically not lower than 0.1 cc/cm$^2$/s.

Further, regarding a degradation rate in air permeability, which is calculated by (air permeability after washing−initial air permeability)/initial air permeability, the air permeability degradation rate after 10-times washing is not greater than 30% in the case of the modified monofilament being diamond-shaped. The air permeability degradation rate after 10-times washing can be not greater than 20%, and can be 0% when, for example, the weaving density is adjusted. Further, the air permeability degradation rate after 20-times washing is not greater than 50% in the case of the modified monofilament being diamond-shaped. The air permeability degradation rate after 20-times washing can be not greater than 40%, and can be 0% when, for example, the weaving density is adjusted.

In the thin woven fabric of the present invention, since a contact area in which the modified monofilament touches the modified monofilament adjacent thereto is great, resistance to abrasion is high. In the thin woven fabric of the present invention, an air permeability, measured by Frazier type method, after 200 times of abrasion can be, for example, not higher than 2.5 cc/cm$^2$/s, is more preferably not higher than 2.0 cc/cm$^2$/s, even more preferably not higher than 1.5 cc/cm$^2$/s, and particularly preferably not higher than 1.0 cc/cm$^2$/s. When the air permeability after abrasion is not higher than 2.5 cc/cm$^2$/s, a woven fabric in which filament split on the fabric surface after abrasion is reduced, and down-proof properties are excellent, can be obtained. The lower limit of the air permeability after 200 times of abrasion is not particularly limited, and is, for example, not lower than 0.05 cc/cm$^2$/s, and typically not lower than 0.1 cc/cm$^2$/s.

In the thin woven fabric of the present invention, even after 200 times of abrasion, a pulling of 4 cm or more, fluffing of 2 mm or more, and hole formation of 1 mm or more are not found, and filament split on the fabric surface after abrasion is reduced. As the most preferable mode of the woven fabric of the present invention, the woven fabric having no pulling, no fluffing, and no holes can be obtained. As a result, the thin woven fabric of the present invention can be made excellent in down-proof properties while being used and consumed.

The thin woven fabric of the present invention which is thus obtained, is a high density woven fabric that is lightweight, is thin, and has a low air permeability, and further has a characteristic that abrasion properties are excellent, unlike in the conventional art. Therefore, the thin woven fabric of the present invention can be preferably used for a side cloth of any of down wear, a down jacket, a windbreaker, a futon, a sleeping bag, rainwear, a tent, a bag, and a rucksack.

EXAMPLES

The following will describe the present invention in detail by the reference of Examples; however, the present invention is not limited thereto. All examples produced by changing or modifying Examples are included in the technical scope of the present invention as far as the examples do not depart from the subject matters of the present invention that have been described above or will be described below.

<Intrinsic Viscosity>

The intrinsic viscosity (IV) is a value defined by measuring the intrinsic viscosity [η] at 30° C. using a mixed solvent of p-chlorophenol and tetrachloroethane (ratio of p-chlorophenol to tetrachloroethane=75/25), and converting the measured value into the intrinsic viscosity (IV) of a mixed solvent of phenol and tetrachloroethane (ratio of phenol to tetrachloroethane=60/40), by the following equation.

$$IV=0.8325\times[\eta]+0.005$$

<Relative Viscosity>

A sample was dissolved in 96.3±0.1% by mass of a concentrated sulfuric acid extra pure reagent to give a polymer concentration of 10 mg/ml. In this way, a sample solution was prepared. An Ostwald viscometer giving a water dropping time of 6 to 7 seconds at a temperature of 20° C.±0.05° C. was used to measure the dropping time $T_1$ (seconds) of 20 ml of the prepared sample solution and the dropping time $T_0$ (seconds) of 20 ml of 96.3±0:1% by mass of the concentrated sulfuric acid extra pure reagent used for the dissolution of the sample, at 20° C.±0.05° C. The relative viscosity (RV) of the used resin was calculated by the following equation.

$$RV=T_1/T_0$$

<Measurement of Monofilament Cross-Section>

(1) Measurement of Length of Side

The length of each side of the cross section of the modified monofilament was measured at 1500 magnifications using a VH-Z450 microscope and a VH-6300 measuring instrument (manufactured by KEYENCE CORPORATION), and the average of the lengths for three monofilaments was obtained as a length of the side.

(2) Measurement of Interior Angle

An image of the cross-section of the modified monofilament was taken at 1500 magnifications using a VH-Z450 microscope and a VH-6300 measuring instrument (manufactured by KEYENCE CORPORATION), and an acute angle and an obtuse angle were measured by a commercially-available protractor (manufactured by KOKUYO), and the average of the angles for three monofilaments was obtained as the angle.

<Single Yarn Fineness (Monofilament Fineness)>

The single yarn fineness was obtained by dividing the total fineness of the synthetic multifilament by the number of filaments.

Single yarn fineness=total fineness/the number of filaments

<Total Fineness>

The fineness (total fineness) of the synthetic multifilament was determined by preparing three skeins of 100-m-long synthetic multifilaments, measuring the mass (g) of each skein, obtaining the average, and multiplying the average by 100.

<Cover Factor>

The cover factor (CF) of the woven fabric was calculated by the following equation.

$$CF=T\times(DT)^{1/2}+W\times(DW)^{1/2}$$

[Where T and W represent a warp density and a weft density (multifilaments/2.54 cm) of the woven fabric, and DT and DW represent the thicknesses (dtex) of the warp and the weft of the woven fabric.]

<Air Permeability>

The air permeability of the woven fabric was measured in compliance with an air permeability A method (Frazier type method) specified in JIS L 1096 8. 27. 1. The initial air permeability represents an air permeability measured when a thin woven fabric which has not been subjected to abrasion test and washing is used as a sample. The air permeability after 200 times of abrasion represents an air permeability measured when a thin woven fabric after 200 times of reciprocations in the abrasion test described below is used as a sample. The sample for air permeability after 200 times of abrasion is a thin woven fabric having been subjected to abrasion test in the warp direction.

<Washing Method>

Washing for the woven fabric was performed in compliance with the requirements specified in the 103 method provided in the dimensional change of a woven fabric in JIS L 1096. "After 10-times washing" represents a result of measurement after washing—spin-drying—drying is repeated 10 times, and "after 20-times washing" represents a result of measurement after washing—spin-drying—drying is repeated 20 times. The drying was performed by hanging. The air permeability after 10-times washing and the air permeability after 20-times washing were measured in the above-described method.

<Contact Length>

A scanning electron microscope (Type JSM-6610 manufactured by JEOL Ltd.) was used to take an image of a cross-section of the thin woven fabric at 350 magnifications, and contact filament lines were drawn at portions at which modified monofilaments touched each other in one multifilament, and all the lengths thereof were measured to obtain the average. Further, contact lengths were similarly measured for 20 synthetic multifilaments, in total, including any 10 warps and any 10 wefts, and the average for the 20 synthetic multifilaments was obtained as the contact length.

<Abrasion Test>

In the abrasion test, a testing machine of rubbing fastness testing machine type II (Gakushin-type) used in JIS L0849, and a commercially-available # A0380 male hook-and-loop fastener manufactured by Kuraray, are used.

FIG. 12-1 shows a testing machine of rubbing fastness testing machine type II (Gakushin-type). The testing machine of rubbing fastness testing machine type II (Gakushin-type) includes a test piece stage, a friction element, a load arm, a horizontal reciprocating unit, and the like. The test piece stage is a table made of a metal, and has a semi-cylindrical shape having a surface radius R of 200 mm. The friction element has a cylindrical curved surface having a surface radius R of 45 mm, and is made of a chemical-resistant metal that allows a white cotton cloth for rubbing (hook-and-loop fastener in examples) to be fixed thereto. The load arm has one end fixed by a stationary shaft, and allows load of 2 N (corresponding to a weight having a mass of about 200 g) to be applied to the friction element at the other end thereof. A distance from the center of the stationary shaft to the center of the friction element is about 110 mm. The load arm can freely rotate about the stationary shaft. The horizontal reciprocating unit allows the test piece stage to horizontally reciprocate by means of a crank, a handle, or the like at a rate of 30 reciprocations per minute over 120 mm, to reciprocate the friction element over 100 mm. The unit of the size in FIG. 12-1 is mm.

The hook-and-loop fastener is cut so as to have a length of about 60 mm and a width of about 20 mm, and is fixed in the longitudinal direction along the friction element of the testing machine. FIG. 12-2 shows a photograph of the side surface of the hook-and-loop fastener fixed to the friction element. FIG. 12-3 shows a photograph of the upper surface of the hook-and-loop fastener fixed to the friction element. The load of the friction element is adjusted, by 300 g load being added to the friction element, as 500 g load in total.

The thin woven fabric is cut into a test piece having a width of 60 mm and a longitudinal dimension of 230 mm as shown in FIG. 12-4. When abrasion test in the warp direction is performed for the thin woven fabric, the thin woven fabric is cut such that the warps of the thin woven fabric are parallel to the longitudinal direction shown in FIG. 12-4, and is set at the test piece stage. Meanwhile, when the abrasion test in the weft direction is performed for the thin woven fabric, the thin woven fabric is cut such that the wefts of the thin woven fabric are parallel to the longitudinal direction shown in FIG. 12-4, and is set at the test piece stage.

A double-coated adhesive tape (TERAOKA ANCHOR BRAND, the width is 25 mm) is adhered to the test piece stage, and the test piece of the thin woven fabric is set on the double-coated adhesive tape in a natural state. The both ends of the thin woven fabric are fixed by means of a sample fixing member of the testing machine.

The measurement length is 10 cm, and a rubbing rate is 30 reciprocates/minute, and the number of times of reciprocations is 200. The hook-and-loop fastener is replaced with a new one for each one measurement (per 200 reciprocations).

<Abrasion Evaluation>

Based on a table indicated below, as the state after rubbing, three phenomena of: pulling; fluffing; and hole formation, were observed and evaluated. The states were evaluated as "impossible" when at least one of items was determined as "remarkably noticeable". For example, in a case where, although fluffing and hole formation were not observed, when only a pulling of 4 cm or more occurred and was determined as "remarkably noticeable", the states were determined as being impossible.

Further, in the evaluation of the states, when pulling, fluffing, or hole formation was observed at a plurality of portions, the longest pulling, the longest fluffing, and the longest hole were evaluated. One measurement was performed in each of the warp direction and the weft direction, and the result that was the worse of the evaluations for the warp direction and the weft direction was regarded as a result of the measurement for evaluation of abrasion.

The measurement criteria for the length of a pulling, fluffing, and a hole are as follows.

The length of a pulling is a length, in the friction direction, of a portion in which the woven fabric is shrunk.

The length of fluffing is a length of fluff that is raised in the direction perpendicular to the surface of the woven fabric.

The length of a hole is a length, in the friction direction, of a portion at which the back portion is seen through the woven fabric.

TABLE 2

| State after abrasion | Item | Criterion | Judgment |
|---|---|---|---|
| Pulling | None | Not observed visually | excellent |
| | Observed | greater than 0 to less than 4 cm | good |
| | Remarkably noticeable | 4 cm or more | impossible |
| Fluffing | None | Not observed visually | excellent |
| | Observed | greater than 0 to less than 2 mm | good |
| | Remarkably noticeable | 2 mm or more | impossible |
| Hole formation | None | Not observed visually | excellent |
| | Observed | greater than 0 to less than 1 mm | good |
| | Remarkably noticeable | 1 mm or more | impossible |

<Tear Strength>

A tear strength of the woven fabric was measured in both the warp direction and the weft direction in compliance with the tear strength D method (pendulum method) specified in JIS L 1096 8.15.5.

Example 1

Nylon 6 polymer chips having a relative viscosity of 3.5 were melted and spun from a spinneret having seven discharge holes (each having the shape shown in FIG. 7 (L1: 0.481 mm, L2: 0.481 mm, L3: 0.07 mm, angle a: 54°)) at a spinning temperature of 282° C. A speed of a first godet roller of two godet rollers was set as 2800 m/minute and a speed of a second godet roller thereof was set as 4000 m/minute, and drawing was performed at a second godet roll temperature of 160° C., thereby obtaining a synthetic multifilament having a fineness of 22 dtex and seven monofilaments each of which had a diamond-shaped cross section having an angle a of 54°, sides A and A': 18.7 μm, and sides B and B': 18.7 μm in the substantially quadrilateral shape shown in FIG. 1. The synthetic multifilaments were used as warps and wefts, and were woven into taffeta weave (plain weave) such that the warp density of the woven fabric was 170 multifilaments/2.54 cm and the weft density of the woven fabric was 180 multifilaments/2.54 cm.

The obtained gray woven fabric was refined in a usual manner by using an open soaper, and was preset by using a pin tenter at 190° C. for 30 seconds, and was dyed into gray with an acid dye by using a jet dyeing machine (HISAKA WORKS, LTD.: CIRCULAR NS). Thereafter, softening finish was performed, and middle-setting was performed at 180° C. for 30 seconds. Thereafter, one surface of the woven fabric was subjected to calendering (processing condition: 185° C., pressure: 2.45 MPa, speed: 15 m/minute) twice.

The warp density, the weft density, the air permeability, the tear strength, and abrasion of the obtained fabric were evaluated. The results are indicated in a table.

Example 2

A synthetic multifilament and a woven fabric were produced in the same manner as in example 1 except that the angle a in a spinneret was changed to 85°. The obtained synthetic multifilament and woven fabric were evaluated in the same manner as in example 1. The results are indicated in the table.

Example 3

A synthetic multifilament and a woven fabric were produced in the same manner as in example 1 except that the angle a in a spinneret was changed to 35°. The obtained synthetic multifilament and woven fabric were evaluated in the same manner as in example 1. The results are indicated in the table.

Example 4

A synthetic multifilament and a woven fabric were produced in the same manner as in example 1 except that holes, in a spinneret, for a diamond were set such that sides A and A': 18.7 μm and sides B and B': 28.0 μm were satisfied. The obtained synthetic multifilament and woven fabric were evaluated in the same manner as in example 1. The results are indicated in the table.

Example 5

A synthetic multifilament and a woven fabric were produced in the same manner as in example 1 except that the synthetic multifilaments were woven into a ripstop taffeta 1 (indicated as "rip 1" in the table) shown in FIG. 6-2. The obtained synthetic multifilament and woven fabric were evaluated in the same manner as in example 1. The results are indicated in the table.

Example 6

A synthetic multifilament which had a fineness of 6 dtex and which included three monofilaments each having a diamond-shaped cross section having A and A': 14.7 μm and sides B and B': 14.7 μm, was obtained in the same manner as in example 1 except that a discharge rate of an extruder was changed such that the fineness of the obtained synthetic multifilament was 6 dtex. Further, a woven fabric was produced from the synthetic multifilaments in the same manner as in example 1. The obtained synthetic multifilament and woven fabric were evaluated in the same manner as in example 1. The results are indicated in the table.

Example 7

A synthetic multifilament which had a fineness of 56 dtex and which included 24 monofilaments each having a diamond-shaped cross section having A and A': 15.9 μm and B and B': 15.9 μm, was obtained in the same manner as in example 1 except that a discharge rate of an extruder was changed such that the fineness of the obtained synthetic multifilament was 56 dtex. Further, a woven fabric was produced from the synthetic multifilaments in the same manner as in Example 1. The obtained synthetic multifilament and woven fabric were evaluated in the same manner as in example 1. The results are indicated in the table.

Example 8

A synthetic multifilament which had a fineness of 22 dtex and which included 18 monofilaments each having a diamond-shaped cross section having A and A': 11.5 μm and sides B and B': 11.5 μm, was obtained in the same manner as in example 1 except that a discharge rate of an extruder was changed such that the fineness of the obtained synthetic multifilament was 22 dtex. Further, a woven fabric was produced from the synthetic multifilaments in the same manner as in Example 1. The obtained synthetic multifilament and woven fabric were evaluated in the same manner as in example 1. The results are indicated in the table.

Example 9

A synthetic multifilament which had a fineness of 22 dtex and which included three monofilaments each having a diamond-shaped cross section having A and A': 28.3 μm and sides B and B': 28.3 μm, was obtained in the same manner as in example 1 except that a discharge rate of an extruder was changed such that the fineness of the obtained synthetic multifilament was 22 dtex. Further, a woven fabric was produced from the synthetic multifilaments in the same manner as in Example 1.

The obtained synthetic multifilament and woven fabric were evaluated in the same manner as in example 1. The results are indicated in the table.

Example 10

A woven fabric was produced in the same manner as in example 1 except that, when woven, densities of the synthetic multifilaments used for warps and wefts were set such that the warp density was 152 multifilaments/2.54 cm and the weft density was 150 multifilaments/2.54 cm. The obtained synthetic multifilament and woven fabric were evaluated in the same manner as in example 1. The results are indicated in the table.

Example 11

A woven fabric was produced in the same manner as in example 1 except that, when woven, densities of the synthetic multifilaments used for warps and wefts were set such that the warp density was 310 multifilaments/2.54 cm and the weft density was 190 multifilaments/2.54 cm. The obtained synthetic multifilament and woven fabric were evaluated in the same manner as in example 1. The results are indicated in the table.

Example 12

A synthetic multifilament and a woven fabric were produced in the same manner as in example 1 except that a resin of the synthetic multifilament used in weaving, was changed to polyester. The obtained synthetic multifilament and woven fabric were evaluated in the same manner as in example 1. The results are indicated in the table.

Example 13

A synthetic multifilament and a woven fabric were produced in the same manner as in example 1 except that the angle a in a spinneret was changed to 90° and the shape of the discharged modified monofilament was changed to a square. The obtained synthetic multifilament and woven fabric were evaluated in the same manner as in example 1. The results are indicated in the table.

Example 14

Yarns described in example 1 were used as warps and wefts, and were woven into a ripstop taffeta 2 (indicated as "rip 2" in the table), shown in FIG. 6-3, having the warp density of 130 multifilaments/2.54 cm and the weft density: 130 multifilaments/2.54 cm. The taffeta was dyed in a usual manner and subjected to dyeing-finish in a known method. Therefore, calendering was performed once. Thereafter, the woven fabric was immersed into a 6% solution of ASAHI-GUARD (registered trademark) AG710 (water repellent manufactured by ASAHI GLASS CO., LTD.), and squeezed by a mangle and dried, and was thereafter subjected to heat treatment at 160° C. for 30 seconds. Meanwhile, resins described below were applied onto release paper by a knife coater, and dried at 100° C. by using an air oven, thereby obtaining a nonporous film. The resin film was applied to the back surface of the woven fabric by lamination for the fabric by using adhesive resin. The obtained results are indicated in the table. Further, FIG. 5 shows an SEM photograph of a cross-section of the obtained thin woven fabric that has been subjected to lamination.

75 parts of water-swelling ester-based polyurethane resin
35 part of water-swelling ether-based polyurethane resin
80 parts of N, N'-dimethylformamide
10 parts of HU-720P (moisture absorbing/releasing fine particle: manufactured by Japan Exlan Co., LTD.)
3 parts of CORONATE (registered trademark) HL Example 15

A synthetic multifilament having 22 dtex and seven round-shaped monofilaments, was obtained by the diameter of a hole in a spinneret being changed to 0.2 mm and the cross-section of the discharged monofilament being changed to a round shape. The synthetic multifilament including the round-shaped monofilaments and the synthetic multifilament including diamond-shaped monofilaments used in Example 1 were woven into taffeta weave (see FIG. 6-1). In the weaving, as warps and wefts, the round-shaped filaments and the diamond-shaped filaments are alternately used at a ratio of 1:1, and, consequently, a ratio in weight between filaments having the diamond-shaped cross-sections and filaments having the round cross-sections in the entire weight of the woven fabric, was made 1:1 (the percentage for the diamond was made 50% of the entirety of the woven fabric). Except for this, the evaluation was made in the same manner as in example 1. The results are indicated in the table.

Comparative Example 1

A synthetic multifilament and a woven fabric were produced in the same manner as in example 1 except that the diameter of a hole in a spinneret was changed to 0.2 mm, and the shape of the discharged modified monofilament was changed to a round shape. The obtained synthetic multifilament and woven fabric were evaluated in the same manner as in example 1. Although evaluation for abrasion was relatively good, air permeability is high and this was not appropriate for a side cloth for down wear. The results for down wear are indicated in the table.

Comparative Example 2

A synthetic multifilament which had a fineness of 22 dtex and had 20 filaments was obtained in the same manner as in example 1 except that the number of obtained synthetic multifilaments was 20, the diameter of a hole in a spinneret was changed to 0.2 mm, and the cross-section was changed to a round shape. Further, the synthetic multifilament was used to produce a woven fabric in the same manner as in example 1. The obtained synthetic multifilament and woven fabric were evaluated in the same manner as in example 1. The results are indicated in the table. Since the single yarn fineness was small, abrasion properties were insufficient.

Comparative Example 3

A synthetic multifilament and a woven fabric were produced in the same manner as in example 1 except that the woven fabric was not subjected to calendering. The obtained synthetic multifilament and woven fabric were evaluated in the same manner as in Example 1. The results are indicated in the table. Since the woven fabric was not compressed by calendering, adhesion between modified monofilaments adjacent to each other was poor, and air permeability was improper. Further, it was observed that the monofilaments were disposed in two layers, and abrasion properties were thus not good.

TABLE 3

| | | Example 1 | Example 2 | Example 3 | Example 4 | Example 5 | Example 6 | Example 7 | Example 8 | Example 9 |
|---|---|---|---|---|---|---|---|---|---|---|
| Material | — | nylon | nylon | nylon | nylon | nylon | nylon | nylon | nylon | nylon |
| Total fineness | dtex | 22 | 22 | 22 | 22 | 22 | 6 | 56 | 22 | 22 |
| Modified monofilament | the number of monofilaments | 7 | 7 | 7 | 7 | 7 | 3 | 24 | 18 | 3 |
| Single yarn fineness | dtex | 3.1 | 3.1 | 3.1 | 3.1 | 3.1 | 2.0 | 2.3 | 1.2 | 7.3 |
| Filament transverse cross-section | — | diamond | diamond | diamond | Parallel-ogram | diamond | diamond | diamond | diamond | diamond |
| Angle a, a' | degree | 54 | 85 | 35 | 54 | 54 | 54 | 54 | 54 | 54 |
| Angle b, b' | degree | 126 | 95 | 145 | 126 | 126 | 126 | 126 | 126 | 126 |
| Total of angles of quadrilateral shape | degree | 360 | 360 | 360 | 360 | 360 | 360 | 360 | 360 | 360 |
| Sides A, A' | μm | 18.7 | 16.8 | 22.2 | 18.7 | 18.7 | 14.7 | 15.9 | 11.5 | 28.3 |
| Sides B, B' | μm | 18.7 | 16.8 | 22.2 | 28 | 18.7 | 14.7 | 15.9 | 11.5 | 28.3 |
| Content of modified monofilament | % | 100 | 100 | 100 | 100 | 100 | 100 | 100 | 100 | 100 |
| Weaving pattern | — | taffeta | taffeta | taffeta | taffeta | rip 1 | taffeta | taffeta | taffeta | taffeta |
| Warp density of woven fabric | multifilaments/ 2.54 cm | 170 | 170 | 170 | 170 | 182 | 350 | 120 | 170 | 170 |
| Weft density of woven fabric | multifilaments/ 2.54 cm | 180 | 180 | 180 | 180 | 183 | 330 | 110 | 180 | 180 |
| Finish warp density | multifilaments/ 2.54 cm | 186 | 186 | 186 | 186 | 198 | 360 | 125 | 186 | 186 |
| Finish weft density | multifilaments/ 2.54 cm | 192 | 192 | 192 | 192 | 199 | 340 | 115 | 192 | 192 |
| Cover factor after finished | — | 1772 | 1772 | 1772 | 1772 | 1862 | 1714 | 1795 | 1772 | 1772 |
| Calendering | — | performed | performed | performed | performed | performed | performed | performed | performed | performed |
| Lamination | — | — | — | — | — | — | — | — | — | — |
| Contact length (warp) | μm | 16.0 | 16.0 | 21.0 | 18.0 | 18.0 | 14.0 | 15.0 | 10.0 | 31.0 |
| Contact length (weft) | μm | 13.0 | 16.0 | 20.5 | 17.3 | 17.4 | 13.0 | 15.0 | 8.6 | 30.0 |
| Average contact length | μm | 14.5 | 16.0 | 20.8 | 17.7 | 17.7 | 13.5 | 15.0 | 9.3 | 30.5 |
| Initial air permeability | $cc/cm^2/s$ | 0.8 | 0.6 | 1.0 | 0.9 | 0.9 | 1.2 | 0.9 | 0.8 | 1.4 |
| Air permeability after (10 times) washing | $cc/cm^2/s$ | 0.8 | 0.6 | 1.0 | 0.9 | 1.0 | 1.4 | 0.9 | 0.9 | 1.4 |
| Air permeability after (20 times) washing | $cc/cm^2/s$ | 1.0 | 0.8 | 1.2 | 1.0 | 1.2 | 1.5 | 1.1 | 1.1 | 1.5 |
| Abrasion evaluation (200 times)/warp | grade | excellent | excellent | good | excellent | excellent | good | excellent | good | excellent |
| Abrasion evaluation (200 times)/weft | grade | excellent | excellent | good | excellent | excellent | good | excellent | good | excellent |
| Air permeability after (200 times) abrasion | $cc/cm^2/s$ | 0.8 | 0.8 | 1.1 | 1.1 | 1.1 | 1.4 | 1.1 | 1.1 | 1.5 |
| Tear strength (warp × weft) | N | 10 × 8 | 7 × 6 | 10 × 9 | 10 × 8 | 13 × 12 | 6 × 6 | 20 × 18 | 10 × 8 | 11 × 9 |

TABLE 4

| | | Example 10 | Example 11 | Example 12 | Example 13 | Example 14 |
|---|---|---|---|---|---|---|
| Material | — | nylon | nylon | ester | nylon | nylon |
| Total fineness | dtex | 22 | 22 | 22 | 22 | 22 |
| Modified monofilament | the number of monofilaments | 7 | 7 | 7 | 7 | 7 |
| Single yarn fineness | dtex | 3.1 | 3.1 | 3.1 | 3.1 | 3.1 |
| Filament transverse cross-section | — | diamond | diamond | diamond | square | diamond |
| Angle a, a' | degree | 54 | 54 | 54 | 90 | 54 |
| Angle b, b' | degree | 126 | 126 | 126 | 90 | 126 |
| Total of angles of quadrilateral shape | degree | 360 | 360 | 360 | 360 | 360 |
| Sides A, A' | μm | 18.7 | 18.7 | 16.7 | 16.6 | 18.7 |
| Sides B, B' | μm | 18.7 | 18.7 | 16.7 | 16.6 | 18.7 |
| Content of modified monofilament | % | 100 | 100 | 100 | 100 | 100 |
| Weaving pattern | — | taffeta | taffeta | taffeta | taffeta | rip 2 |
| Warp density of woven fabric | multifilaments/2.54 cm | 152 | 310 | 170 | 170 | 130 |
| Weft density of woven fabric | multifilaments/2.54 cm | 150 | 190 | 180 | 180 | 130 |
| Finish warp density | multifilaments/2.54 cm | 160 | 330 | 186 | 186 | 140 |
| Finish weft density | multifilaments/2.54 cm | 160 | 200 | 192 | 192 | 140 |
| Cover factor after finished | — | 1500 | 2485 | 1772 | 1772 | 1313 |
| Calendering | — | performed | performed | performed | performed | performed |
| Lamination | — | — | — | — | — | performed |
| Contact length (warp) | μm | 18.0 | 18.0 | 16.0 | 16.0 | 18.0 |
| Contact length (weft) | μm | 17.0 | 17.5 | 16.0 | 12.0 | 17.5 |
| Average contact length | μm | 17.5 | 17.8 | 16.0 | 14.0 | 17.8 |
| Initial air permeability | $cc/cm^2/s$ | 2.0 | 0.2 | 0.9 | 0.9 | 0.8 |
| Air permeability after (10 times) washing | $cc/cm^2/s$ | 2.5 | 0.2 | 0.9 | 2.5 | 0.8 |
| Air permeability after (20 times) washing | $cc/cm^2/s$ | 2.8 | 0.4 | 1.0 | 2.0 | 1.0 |
| Abrasion evaluation (200 times)/warp | grade | good | excellent | excellent | good | good |
| Abrasion evaluation (200 times)/weft | grade | good | excellent | excellent | good | good |
| Air permeability after (200 times) abrasion | $cc/cm^2/s$ | 2.0 | 0.3 | 1.1 | 2.5 | 0.8 |
| Tear strength (warp × weft) | N | 14 × 10 | 9 × 9 | 8 × 8 | 8 × 8 | 10 × 8 |

| | | Example 15 | Comparative example 1 | Comparative example 2 | Comparative example 3 |
|---|---|---|---|---|---|
| Material | — | nylon | nylon | nylon | nylon |
| Total fineness | dtex | 22 | 22 | 22 | 22 |
| Modified monofilament | the number of monofilaments | 7 | 7 | 20 | 7 |
| Single yarn fineness | dtex | 3.1 | 3.1 | 1.1 | 3.1 |
| Filament transverse cross-section | — | diamond/ round | round | round | diamond |
| Angle a, a' | degree | 54 | — | — | 54 |
| Angle b, b' | degree | 126 | — | — | 126 |
| Total of angles of quadrilateral shape | degree | 360 | — | — | 360 |
| Sides A, A' | μm | 18.7 | — | — | 18.7 |
| Sides B, B' | μm | 18.7 | — | — | 18.7 |
| Content of modified monofilament | % | 50 | 0 | 0 | 100 |
| Weaving pattern | — | taffeta | taffeta | taffeta | taffeta |
| Warp density of woven fabric | multifilaments/2.54 cm | 170 | 170 | 170 | 170 |
| Weft density of woven fabric | multifilaments/2.54 cm | 180 | 180 | 180 | 180 |
| Finish warp density | multifilaments/2.54 cm | 186 | 186 | 186 | 183 |
| Finish weft density | multifilaments/2.54 cm | 192 | 192 | 192 | 188 |
| Cover factor after finished | — | 1772 | 1772 | 1772 | 1772 |
| Calendering | — | performed | performed | performed | not performed |
| Lamination | — | — | — | — | — |
| Contact length (warp) | μm | 9.8 | 7.8 | 6.0 | 5.0 |
| Contact length (weft) | μm | 9.4 | 7.6 | 6.2 | 4.0 |
| Average contact length | μm | 9.6 | 7.7 | 6.1 | 4.5 |
| Initial air permeability | $cc/cm^2/s$ | 1.5 | 3.0 | 0.7 | 34.0 |
| Air permeability after (10 times) washing | $cc/cm^2/s$ | 1.9 | 4.0 | 1.5 | 44.0 |
| Air permeability after (20 times) washing | $cc/cm^2/s$ | 2.4 | 4.4 | 2.0 | 49.0 |
| Abrasion evaluation (200 times)/warp | grade | good | good | impossible | impossible |
| Abrasion evaluation (200 times)/weft | grade | good | good | impossible | impossible |
| Air permeability after (200 times) abrasion | $cc/cm^2/s$ | 2.0 | 3.8 | 1.5 | 40.0 |
| Tear strength (warp × weft) | N | 10 × 9 | 8 × 8 | 9 × 9 | 10 × 10 |

DESCRIPTION OF THE REFERENCE CHARACTERS

A, A', B, B', L1, L2: each represents a length of side of substantially quadrilateral shape a, a', b, b': each represents an interior angle of substantially quadrilateral shape P, Q, R, S: each represents a convex portion T, U, V, W: each represents a concave portion L3: represents a depth of concave portion

The invention claimed is:

1. A woven fabric comprising a synthetic multifilament comprising a modified monofilament having a filament transverse cross-section of a substantially quadrilateral shape, wherein, the synthetic multifilament has a total fineness of not less than 5 dtex and not greater than 60 dtex, the modified monofilament has a single yarn fineness of not less than 1.0 dtex and not greater than 7.5 dtex, the woven fabric includes the synthetic multifilament in an amount of 45% or more by mass relative to 100% by mass of the woven fabric, the synthetic multifilament has an arrangement where the modified monofilaments are lined in one layer on the cross-section in the direction perpendicular to the synthetic multifilament, and an average contact length where the modified monofilament touches a modified monofilament adjacent thereto in one synthetic multifilament is not less than 8 μm and not greater than 40 μm on a cross-section in a direction perpendicular to the synthetic multifilament.

2. The woven fabric according to claim 1, wherein the substantially quadrilateral shape is a parallelogram wherein each angle in a pair of opposite angles is not less than 30° and not greater than 90°.

3. The woven fabric according to claim 2, wherein the substantially quadrilateral shape is a parallelogram wherein each angle in a pair of opposite angles is not less than 30° and not greater than 85°.

4. The woven fabric according to claim 2, wherein the substantially quadrilateral shape is a diamond wherein all four sides are equal in length.

5. The woven fabric according to claim 1, wherein a cover factor is not less than 1450 and not greater than 2500.

6. The woven fabric according to claim 1, wherein an initial air permeability measured by Frazier type method is not higher than 2.0 $cc/cm^2/s$.

7. The woven fabric according to claim 1, wherein an air permeability measured by Frazier type method after 200 times of abrasion is not higher than 2.5 $cc/cm^2/s$.

8. The woven fabric according to claim 1, wherein the woven fabric is used for a side cloth of any of down wear, a down jacket, a windbreaker, a futon, a sleeping bag, rainwear, a tent, a bag, and a rucksack.

* * * * *